US011772684B2

(12) United States Patent
Richardson

(10) Patent No.: US 11,772,684 B2
(45) Date of Patent: Oct. 3, 2023

(54) ZIPLINE TROLLEY

(71) Applicant: Michael Troy Richardson, Washington, UT (US)

(72) Inventor: Michael Troy Richardson, Washington, UT (US)

( * ) Notice: Subject to any disclaimer, the term of this patent is extended or adjusted under 35 U.S.C. 154(b) by 504 days.

(21) Appl. No.: 17/071,942

(22) Filed: Oct. 15, 2020

(65) Prior Publication Data

US 2021/0061316 A1 Mar. 4, 2021

Related U.S. Application Data

(63) Continuation-in-part of application No. 16/587,552, filed on Sep. 30, 2019, now Pat. No. 10,807,613, which is a continuation of application No. 15/819,499, filed on Nov. 21, 2017, now Pat. No. 10,471,971.

(Continued)

(51) Int. Cl.

| | |
|---|---|
| ***B61B 12/02*** | (2006.01) |
| ***B61B 7/00*** | (2006.01) |
| ***A63G 21/20*** | (2006.01) |
| ***A63G 21/22*** | (2006.01) |

(52) U.S. Cl.

CPC ..... *B61B 12/028* (2013.01); *A63G 21/20* (2013.01); *A63G 21/22* (2013.01); *B61B 7/00* (2013.01)

(58) Field of Classification Search

CPC ..... A63G 21/20; A63G 21/22; B61B 12/028; B61B 7/00; B61B 12/12; B61B 12/122; B61B 12/02; B61B 12/00; B61H 9/02; A62B 1/14; F16F 1/08

See application file for complete search history.

(56) References Cited

U.S. PATENT DOCUMENTS 6,666,773 B1 * 12/2003 Richardson ..... F16D 63/008 104/204

8,234,980 B2 * 8/2012 Boren ..... A63G 21/22 104/53

(Continued)

*Primary Examiner* — Mark T Le

(74) *Attorney, Agent, or Firm* — Kunzler Bean & Adamson; Scott D. Thorpe

(57) ABSTRACT

For A zip line trolley brake system includes a cable suspended between upper and lower support platforms which, together, function with rider harnessing, loading, and take-off with a passive braking trolley allowing a controlled descent and barrel spring system providing addition braking near the end of a cable termination. The zip line trolley positioned atop a cable includes a frame assembled from a pair of parallel side plates, a four-sided rotational brake pad, and a parabolic groove wheel which is sandwiched between side plates, and a lever. A lever from which a rider is suspended, can be pinned anywhere within the trolley's circular toothed slot instilling a brake force for the cable slope. A trolley brake generally square sides are grooved for cables and fabricated from a durable polymeric material is rotatably within affixed side plates. A spring system includes a football-shape springs, spring spacers, bump spring spacer receiver, and a locking inserts designed to fasten the springs and allow the springs to collapse within themselves reducing the compression length. A bump spring spacer receiver makes contact with the zipline trolley further decelerating the suspended rider as contact is made with the springs.

18 Claims, 48 Drawing Sheets

Related U.S. Application Data

(60) Provisional application No. 62/970,538, filed on Feb. 5, 2020, provisional application No. 62/487,954, filed on Apr. 20, 2017.

(56) References Cited

U.S. PATENT DOCUMENTS

| | | | | |
|---|---|---|---|---|
| 9,004,235 | B2 * | 4/2015 | Headings | B61H 9/02<br>188/65.1 |
| 10,023,208 | B2 * | 7/2018 | Brown | B61H 9/04 |

* cited by examiner

ZIPLINE TROLLEY

CROSS REFERENCE TO RELATED APPLICATIONS

This application is a continuation-in-part application that claims priority to U.S. patent application Ser. No. 16/587,552, entitled "ZIPLINE TROLLEY" and filed on Sep. 30, 2019 for Michael Troy Richardson, which is incorporated herein by reference and is a continuation of and claims priority to U.S. patent application Ser. No. 15/819,499 entitled "ZIPLINE TROLLEY" and filed on Nov. 21, 2017 for Michael Troy Richardson, which is incorporated herein by reference, and which claims priority to U.S. Provisional Patent Application No. 62/487,954 entitled "ZIPLINE TROLLEY" and filed on Apr. 20, 2017 for Michael Troy Richardson, which is incorporated herein by reference. This application further claims priority to U.S. Provisional Patent Application 62/970,538 entitled "ZIPLINE SPRING" and filed on Feb. 5, 2020 for Michael Troy Richardson, which is incorporated herein by reference.

FIELD

The subject matter disclosed herein relates to a zipline trolley.

BACKGROUND

Zipline trolleys must be brought to a safe stop.

BRIEF DESCRIPTION OF THE DRAWINGS

A more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which:

FIG. 265 is a perspective view drawing illustrating one embodiment is a trolley.

DETAILED DESCRIPTION

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Most if not all passive braking zipline trolleys apply brake force to the bottom of the cable. The brake force applied to the bottom of the cable in inclement weather is compromised due to collection of water particles on the bottom of the cable. The brake force of this trolley in inclement weather is severely reduced because the brake force is applied to the bottom of the cable where the collection of moisture is maximized due to water lubrication.

The description of elements in each figure may refer to elements of proceeding figures. Like numbers refer to like elements in all figures, including alternate embodiments of like elements.

Figure 1:
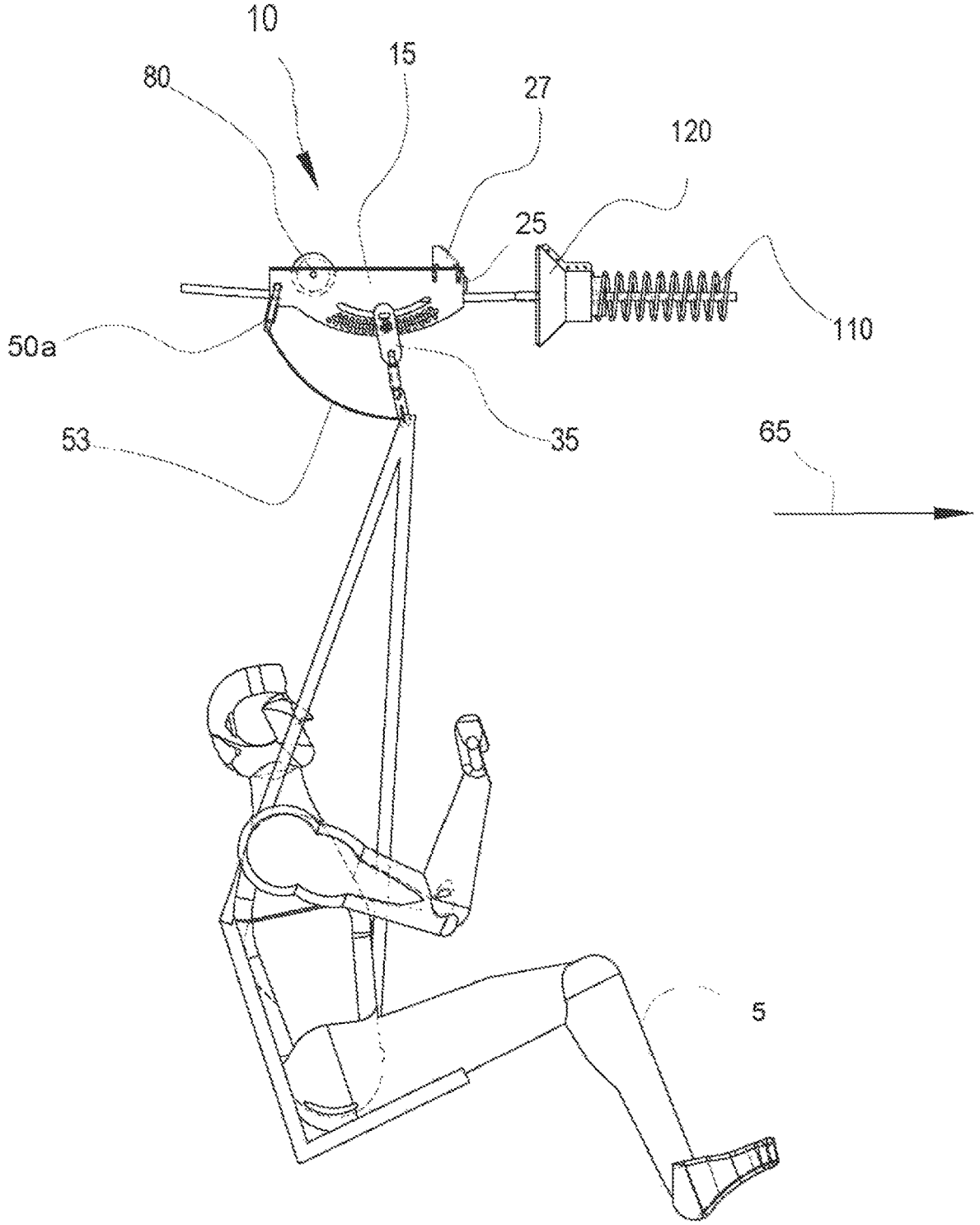
FIG. 1 is a side view drawing of one embodiment of a rider suspended below the zipline trolley.

FIG. 1 is a side view drawing of one embodiment of a rider 5 suspended below the zipline trolley 10. The rider is suspended from a proximal carabinier 50*b*. The zipline trolley 10 includes a frame 15, a wheel 20, a wheel bearing 80, a brake 25, a brake stop angled tab hitch 27, and a rotatable lever 35. A receiver 120 and spring 110 are also shown. The wheel 20 and the brake 25 may travel along a top of the cable 45. The zipline trolley 10 may travel along a cable 45 in a direction of travel 65. The wheel bearing 80 may be a Sprague bearing.

The zipline trolley 10 may experience a significant acceleration while descending a cable. As a result, it may be important to apply a braking force. Unfortunately, in the past, brakes have been large in order to provide a sufficient braking force. In addition, the zipline trolleys have been large, making it difficult to remove the trolleys from the cable 45. The embodiments described herein provide a brake 25 that provides a sufficient braking force within a small volume. As a result, the zipline trolley 10 may be constructed in a small size that is easily removed from the cable 45.

The zipline trolley 10 may make contact with the receiver 120 and may compress the spring 110 or series of springs. If compression occurs, the Sprague wheel bearing 80 will limit roll back of the zipline trolley 10. This view also shows the safety strap 53 connected to a distal carabineer 50*a*.

Figure 2:
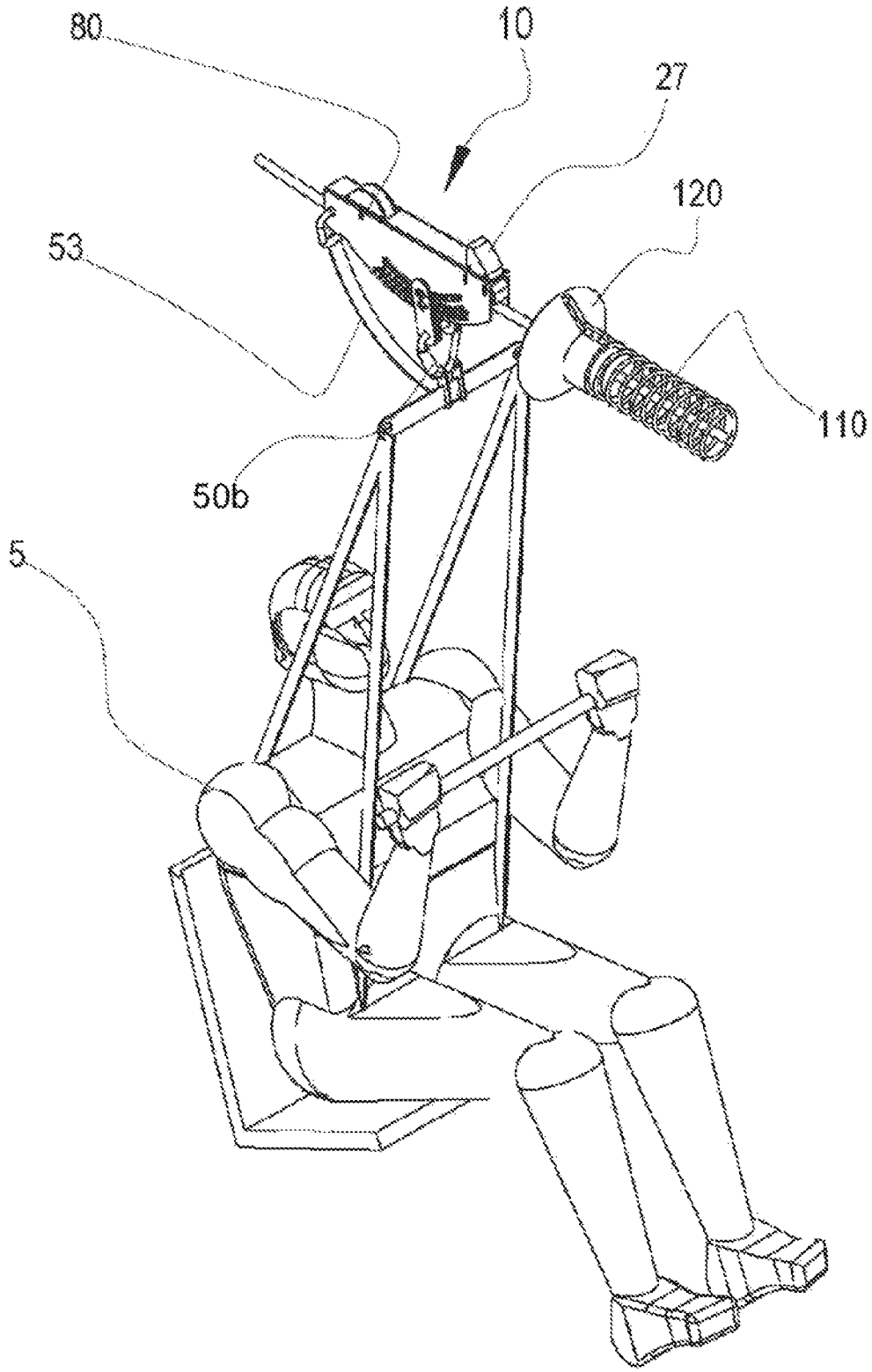
FIG. 2 is a top isometric view drawing showing one embodiment of the brake stop angled tab hitch.

FIG. 2 is a top isometric view drawing showing one embodiment of the brake stop angled tab hitch 27. As the zipline trolley 10 traverses the cable 45, the zipline trolley 10 may make contact with the receiver 120. The receiver 120 may apply additional downward force on the brake stop angled tab hitch 27 to increase the braking force of the brake. The brake stop angled tab hitch 27 may compress the spring 110 to further slow the zipline trolley 10, increasing safety for the rider 5.

Figure 3:
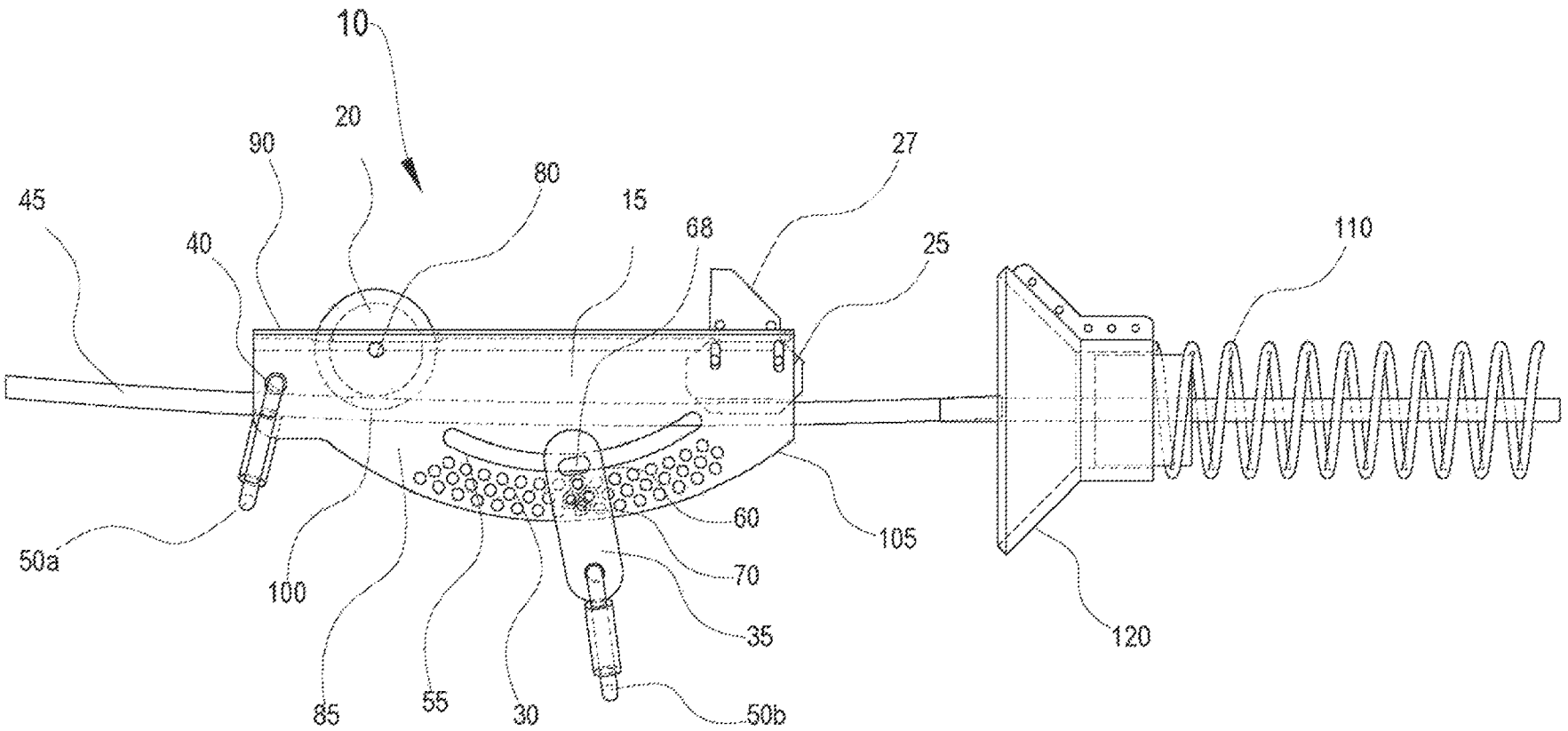
FIG. 3 is a side view cutaway drawing illustrating one embodiment of a zipline trolley.

FIG. 3 is a side view cutaway drawing illustrating one embodiment of a zipline trolley 10. The zipline trolley 10 convey a suspended rider from a proximal carabiner 50*b*. The zipline trolley 10 may travel along a cable 45 in a direction of travel 65. In the depicted embodiment, the zipline trolley 10 includes a wheel 20, a frame 15, a brake 25, a lower slot 85, sliding bar 68, receiver 120, spring 110, and a rotatable lever 35. In this view, the zipline trolley 10 may have stopped before impacting the receiver 120 and compressing the spring 110 or series of springs. This view also shows the brake stop angled tab hitch 27 which may be forced down upon impact with the receiver 120 to initiate a downward force on the brake stop angled tab hitch 27 causing the zipline trolley to decelerate. This view also shows a safety pin 68 passing through the slots of the rotatable lever 35 and the frame 15.

The wheel 20 may be disposed on a distal end 90 of the frame 15. The wheel 20 includes a groove that receives the cable 45 at a lower portion 100 of the wheel 20. In addition, the wheel 20 includes a wheel bearing 80. The wheel bearing 80 may be selected from the group consisting of a Sprague bearing or a trapped bearing. In addition, the wheel bearing 80 may include a spring or configuration that may inhibit roll back when gravity or a compressing spring pack which slows the trolley 10. In one embodiment, the wheel bearing 80 prevents rollback at a stopping point. The stopping point may be at or near the end of the cable 45. The spring 110 and receiver 120 may cushion the impact of the zipline trolley 10 reaching the stopping point.

The brake 25 may be disposed on a proximal end 105 of the frame 15. If the rider 5 and the zipline trolley 10 makes contact with the receiver 120, the brake stop angled tab 27 portion of the brake 25 may contact the receiver 120, applying a downward sheering fricative force on the cable 45 as the zipline trolley 10 transverses the cable 45.

The brake 25 includes a groove along a brake bottom that receives the cable 45. The brake 25 traverses the top of the cable 45. As a result, the operation of the brake 25 is not diminished by moisture on the cable 45, as the moisture migrates to the bottom of the cable 45.

In one embodiment, the brake 25 is formed of a material with a melting point in excess of 200° F. In addition, the brake 25 may be formed of a material with a melting point in excess of 300° F.

The frame 15 includes an array of lever points 30. The array of lever points 30 is disposed between the brake 25 and the wheel 20. A given lever point 30 may be selected as a function of the slope of the zipline. In addition, the given lever point 30 may be selected as a function of a desired maximum speed of the zipline trolley 10. The frame 15 may be formed of one or more of ultra-high molecular weight polyethylene (UHMW), Stainless Steel, Titanium, and high strength carbon steel.

The rotatable lever 35 is connected to a given lever point 30. The rotatable lever 35 may be connected by a rotatable lever connector 70. The rotatable lever 35 may be further connected to the frame 15 by a sliding bar 68 that passes through right and left slider groves 55. As a result, the sliding bar 60 and rotatable lever 35 cannot be detached from the frame 15 without removing the sliding bar 60 from the rotatable lever 35.

A weight such as the rider 5 may be suspended from the rotatable lever 35. In one embodiment, the weight is suspended from the rotatable lever 35 using a proximal carabiner 50*b*. The weight may apply an angular force about the wheel 20 to the brake 25. The force about the wheel 20 causes the brake 25 to apply a fricative force to the cable 45. The force on the brake 25 may control the rate of dissent of the zipline trolley 10 along the cable 45. The force may be applied with a high force to surface area ratio. In one embodiment, the fricative force of the brake 25 is significantly more for the zipline trolley 10 in the direction of travel 65 then against the direction of travel 65. In an alternate embodiment, the zip line trolley 10 may be used to carry a rider 5 against the direction of travel 65 to reduce the fricative force of the brake 25.

The lower slot 85 receives the cable 45. The zipline trolley 10 may be set on the cable 45 and removed from the cable 45 if the rotatable lever 35 is removed from the given lever point 30 and the sliding bar 60 is removed. Because of the high force to surface area ratio, the size of the brake 25 and the zipline trolley 10 may be reduced. As a result, the zipline trolley 10 may be easily placed on the cable 45 at the top of the cable 45 and/or removed from the cable 45 at the bottom of the cable 45.

In one embodiment, the zipline trolley 10 includes safety carabiner holes 40 disposed in the frame 15 and above the cable 45. The distal carabiner 50*a* may be inserted through the carabiner holes 40 and around the cable 45. As a result, the zipline trolley 10 is securely connected to the cable 45.

Figure 4:
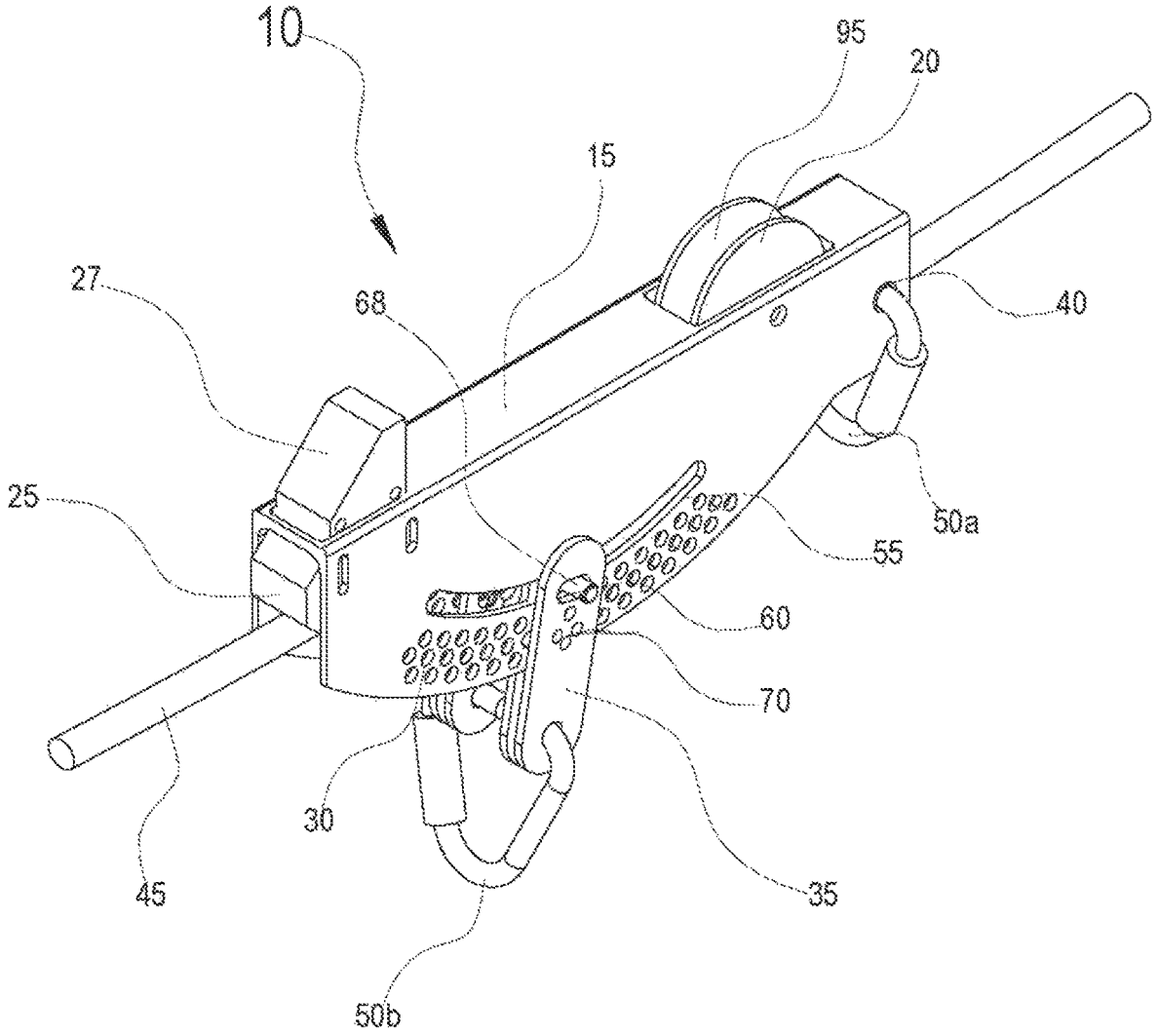
FIG. 4 is a perspective drawing illustrating one embodiment of a zipline trolley.

FIG. 4 is a perspective drawing illustrating one embodiment of the zipline trolley 10. The wheel 20 includes the groove 95. The groove 95 may receive the cable 45 at the lower portion of the wheel 20.

Figure 5:
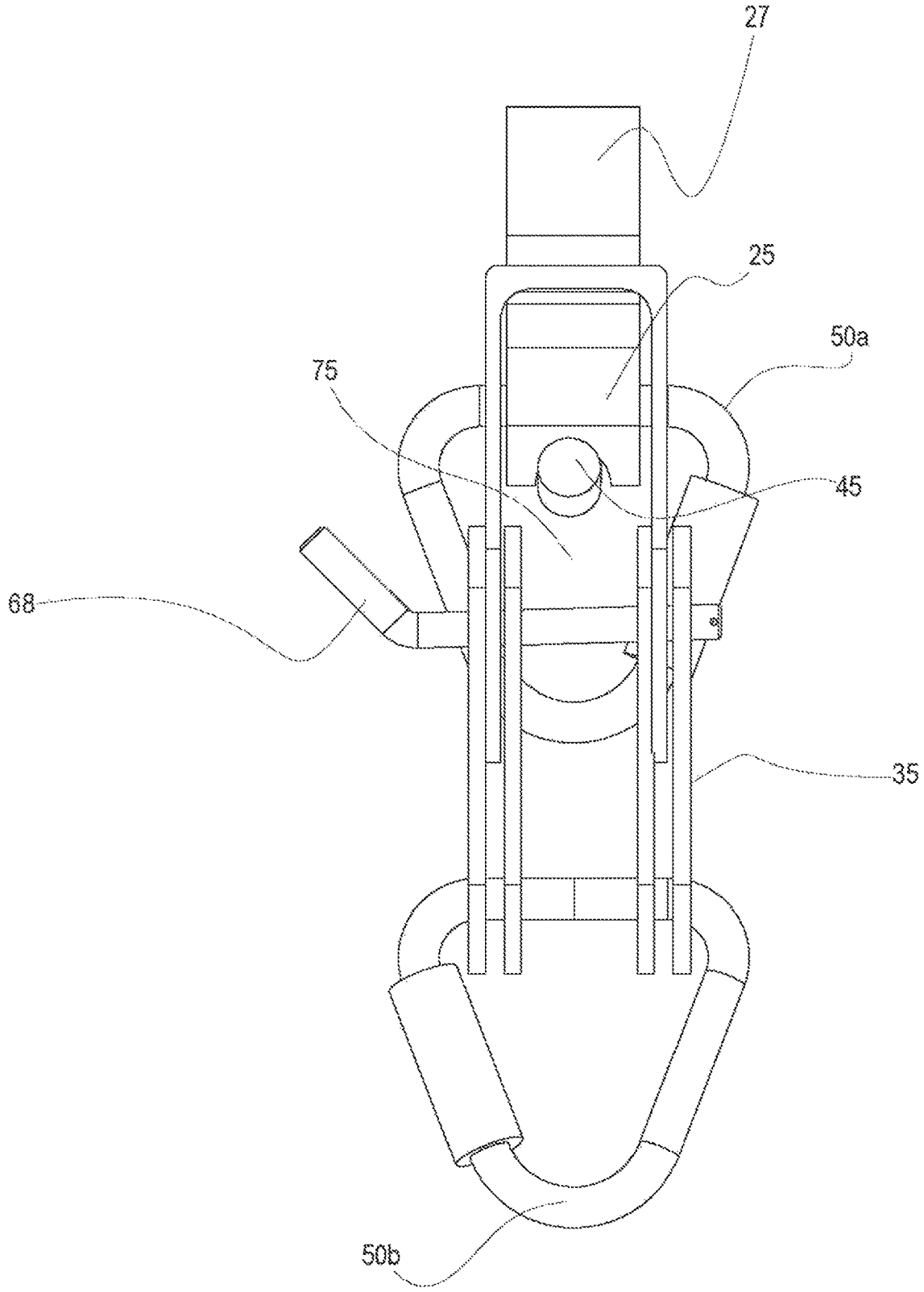
FIG. 5 is a front-view drawing illustrating one embodiment of a zipline trolley.

FIG. 5 is a front-view drawing illustrating one embodiment of the zipline trolley 10. The lower slot 85 is shown. If the carabineers 50*a-b* and the sliding bar 68 are removed from the given lever point 30, the zipline trolley 10 may be set on the cable 45 and/or removed from the cable 45.

Figure 6:
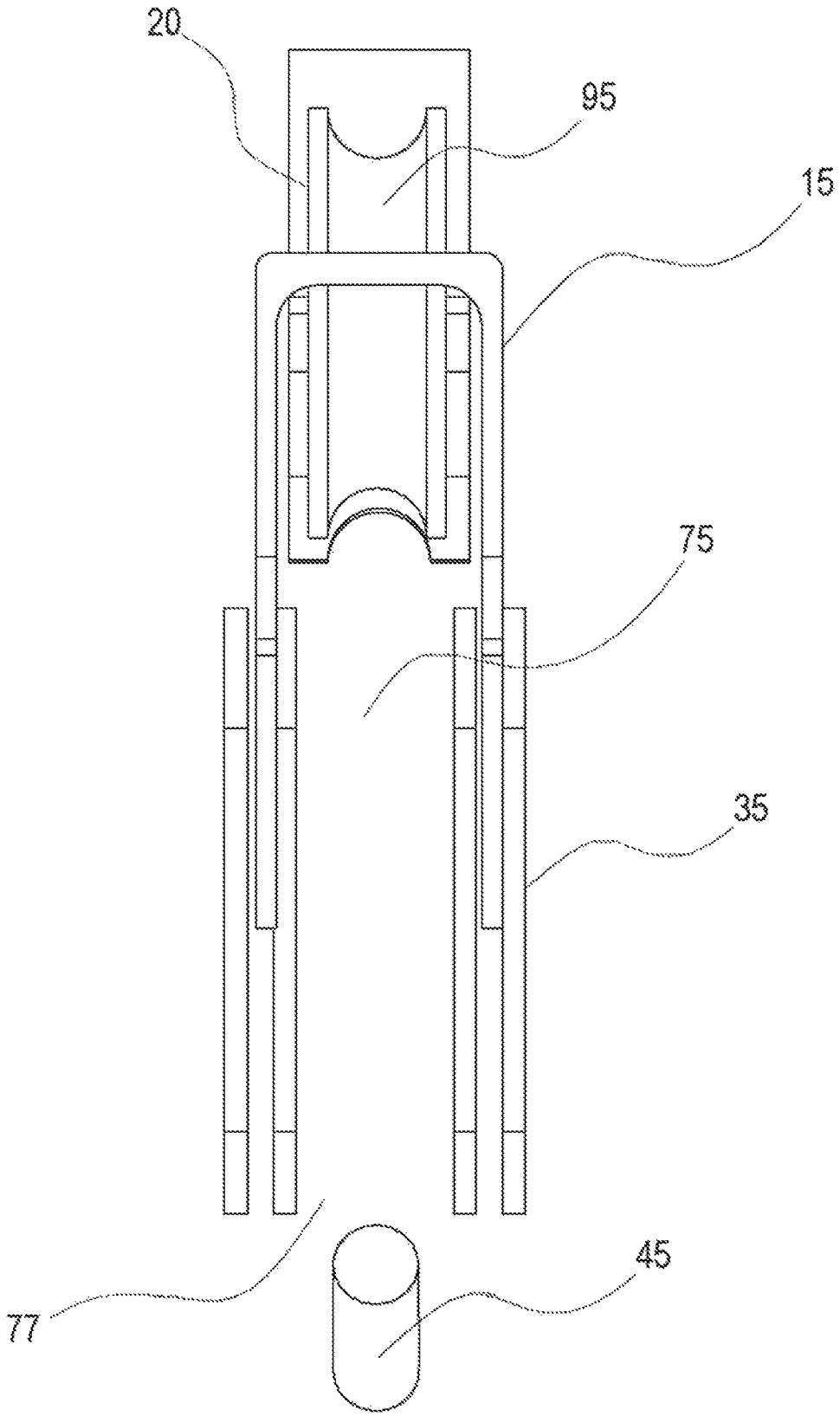
FIG. 6 is a rear-view drawing illustrating one embodiment of the zipline trolley.

FIG. 6 is a rear-view drawing of one embodiment the zipline trolley 10 with the slider bar 68 and the carabineers 50*a-b* removed. The zipline trolley 10 may be set on the cable 45 at an opening 77. The zipline trolley 10 may be lifted from the cable 45 at the clearance 75. The rotatable lever 35 may remain connected to the frame 15 when removing the zipline trolley 10 from the cable 45.

Figure 7:
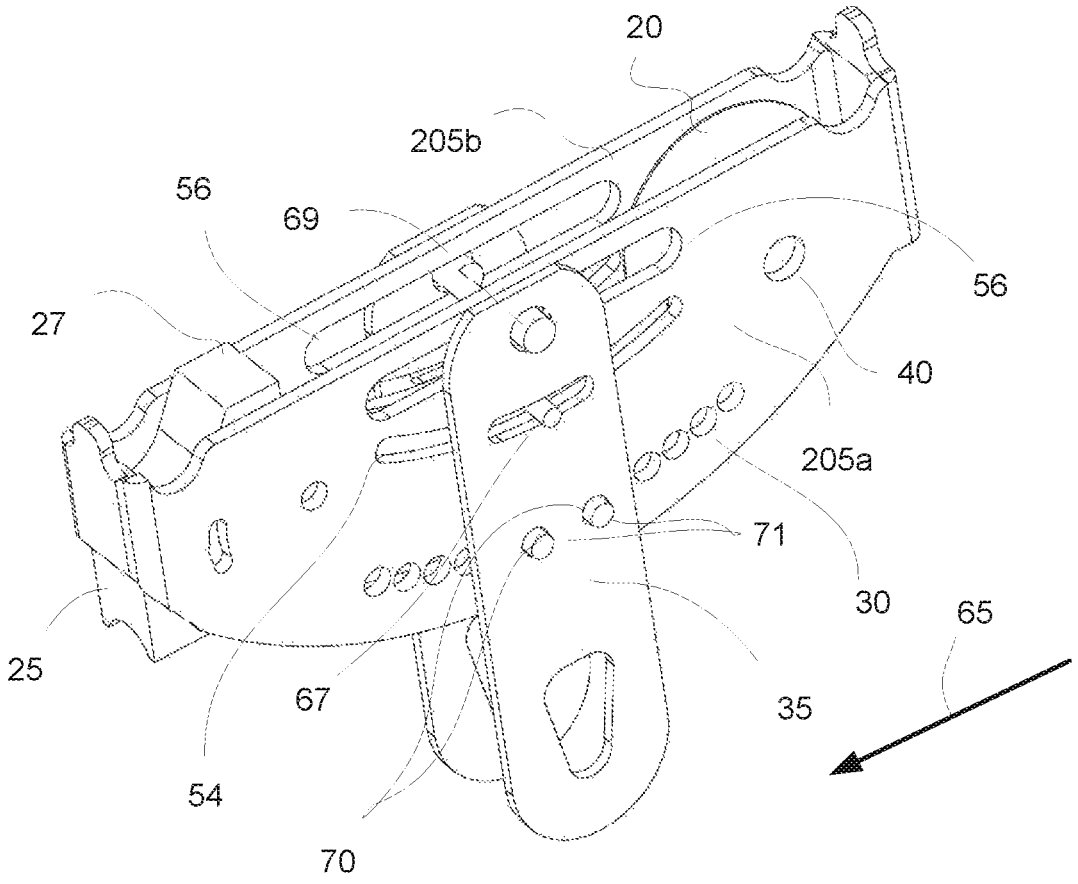
FIG. 7 is a perspective drawing illustrating one alternate embodiment of a zip line trolley.

FIG. 7 is a perspective drawing illustrating one alternate embodiment of the zip line trolley 10. In the depicted embodiment, the rotatable lever 35 is connected to the zip line trolley 10 by an upper sliding bar 69 and a lower sliding bar 67. The upper sliding bar 69 is disposed in an upper sliding groove 56. The lower sliding bar 67 is disposed in a lower sliding groove 54. The upper sliding bar 69 and the lower sliding bar 67 may be free to slide within the upper sliding groove 56 and the lower sliding groove 54 respectively Plunger pins 71 protrude through the lever points 30 and the rotatable lever connector 70 to set a lever angle that adjusts the angular force that is applied about the wheel 20 to the brake 25. The plunger pins 71 may be set to protrude through any pair of lever points 30. The force about the wheel 20 causes the brake 25 to apply a fricative force to the cable 45. Selecting lever points 30 toward the direction of travel 65 increases the force about the wheel 20 that is applied by the brake 25 to the cable 45. Selecting lever points 30 away from the direction of travel 65 decreases the force about the wheel that is applied by the brake 25 to the cable 45. The lever points 30 may be selected based on the slope of the cable 45. If the slope of the cable 45 is steep, lever points 30 near to the brake 25 may be selected to increase the force of the brake 25. If the slope of the cable 45 is shallow, lever points 30 farther from the brake 25 may be selected to decrease the force of the brake 25. The force on the brake 25 may control the rate of dissent of the zipline trolley 10 along the cable 45. The force may be applied with a high force to surface area ratio.

In one embodiment, two trolley body components 205 form the frame 15. The trolley body components 205 may be fabricated separately and assembled together to reduce manufacturing costs.

Figure 8:
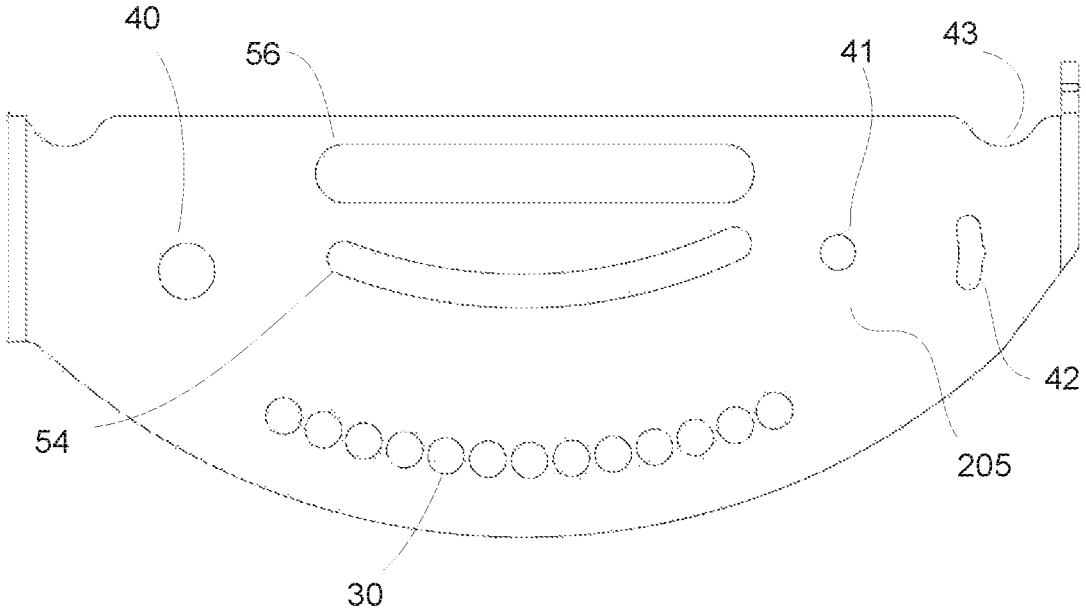
FIG. 8 is a side view drawing illustrating one embodiment of a trolley body component.

FIG. 8 is a side view drawing illustrating one embodiment of the trolley body component 205. In the depicted embodiment, the trolley body component 205 includes the upper slider groove 56, the lower slider groove 54, the lever points 30, the safety carabiner holes 40, a brake hole 41, a brake adjustment hole 42 and an active brake groove 43.

The brake adjustment hole 42 may receive a brake pin, connect the brake 25 to the frame 15, and allow the contact of the brake 25 on the cable 45 to be adjusted. The brake hole 41 may also receive a brake pin and connect the brake 25 to the frame 15.

Figure 9:
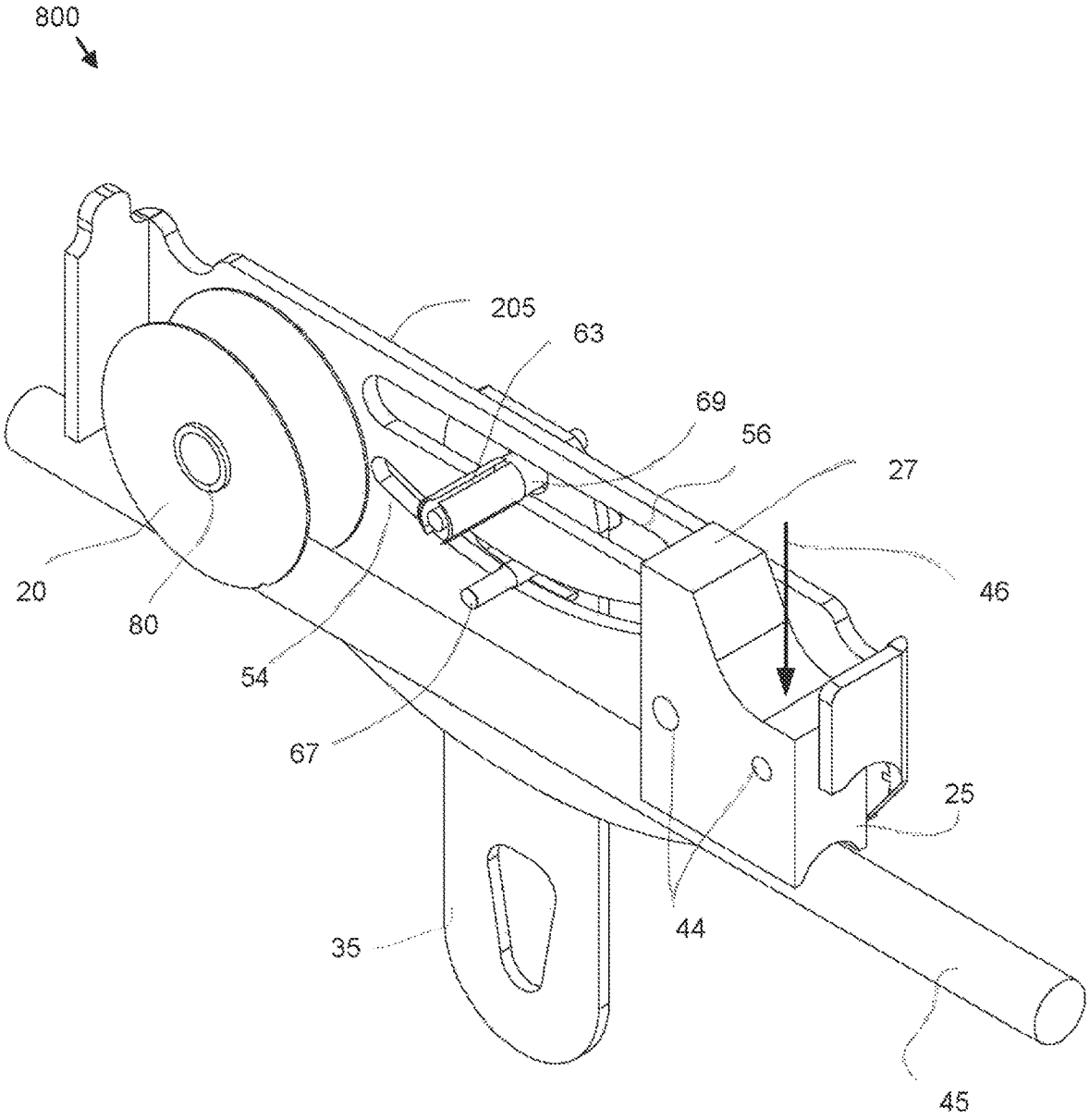
FIG. 9 is a perspective drawing illustrating one embodiment of a zip line trolley interior.

FIG. 9 is a perspective drawing illustrating one embodiment of a zip line trolley interior. In the depicted embodiment, one trolley body component 205 is removed to show the interior of the zip line trolley 10. Brake pins 44 are shown embedded in the brake 25. The brake pins 44 may be set in the brake hole 41 and the brake adjustment hole 42 such that the brake 25 is secured to the frame 15. In addition, the brake pin 44 in the brake adjustment hole 42 may be moved within the brake adjustment hole 42 to adjust the contact of the brake 25 on the cable 45.

If an active braking force 46 is applied to the brake 25, the force applied by the brake 25 to the cable 45 is increased, increasing the fricative resistance of the brake 25 and further slowing the zip line trolley 10.

In the depicted embodiment, the upper sliding bar 69 includes a bar sleeve 63. The bar sleeve 63 may connect to another bar sleeve 63 and/or another upper sliding bar 69 extending from the other trolley body component 205 to connect the upper sliding bars 69.

Figure 10:
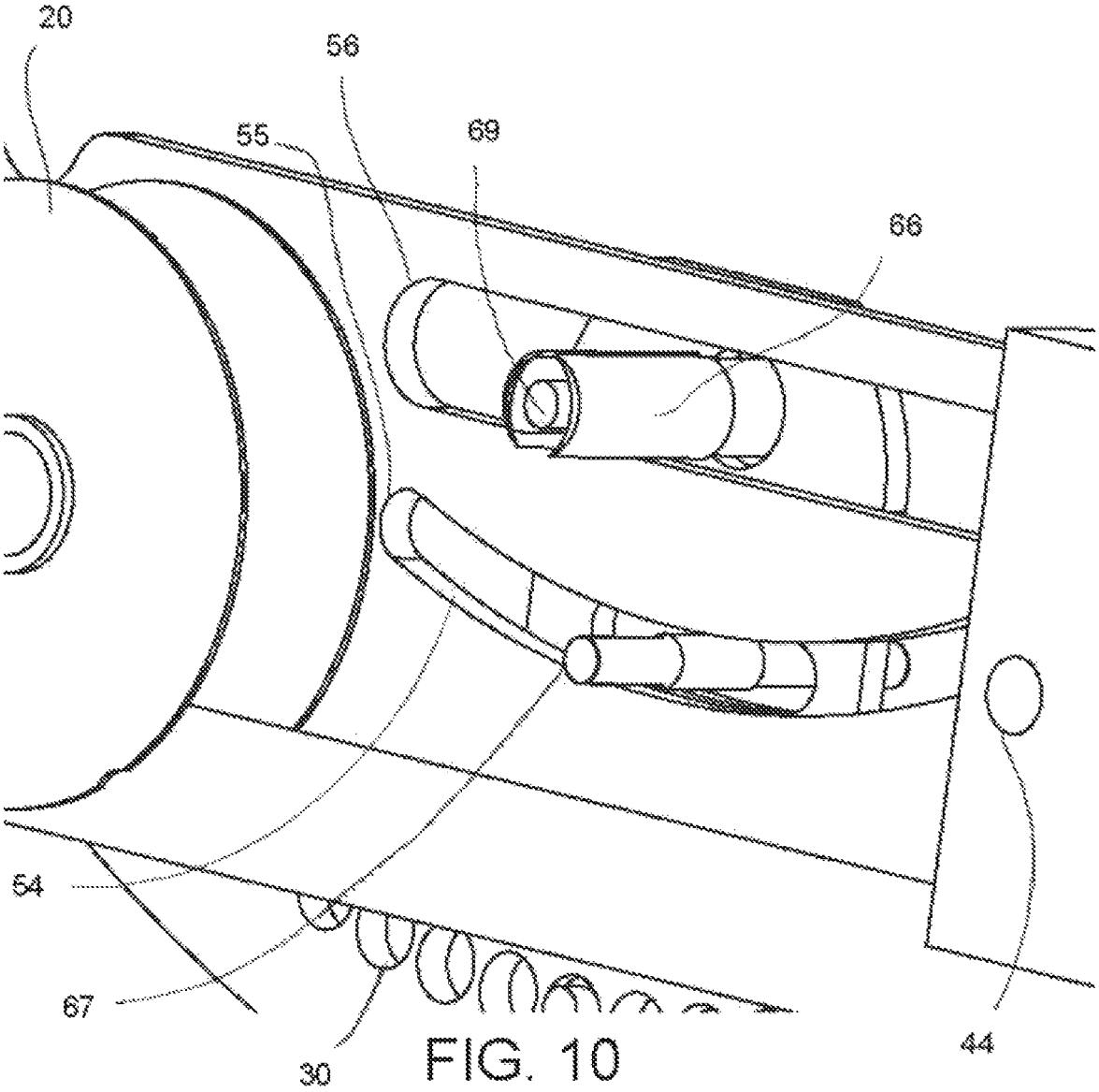
FIG. 10 is a perspective drawing illustrating one embodiment of a zip line trolley interior.

FIG. 10 is a perspective drawing illustrating one embodiment of the zip line trolley interior. In the depicted embodiment, the brake pin 44 and the bar sleeve 63 are shown in greater detail.

Figure 11:
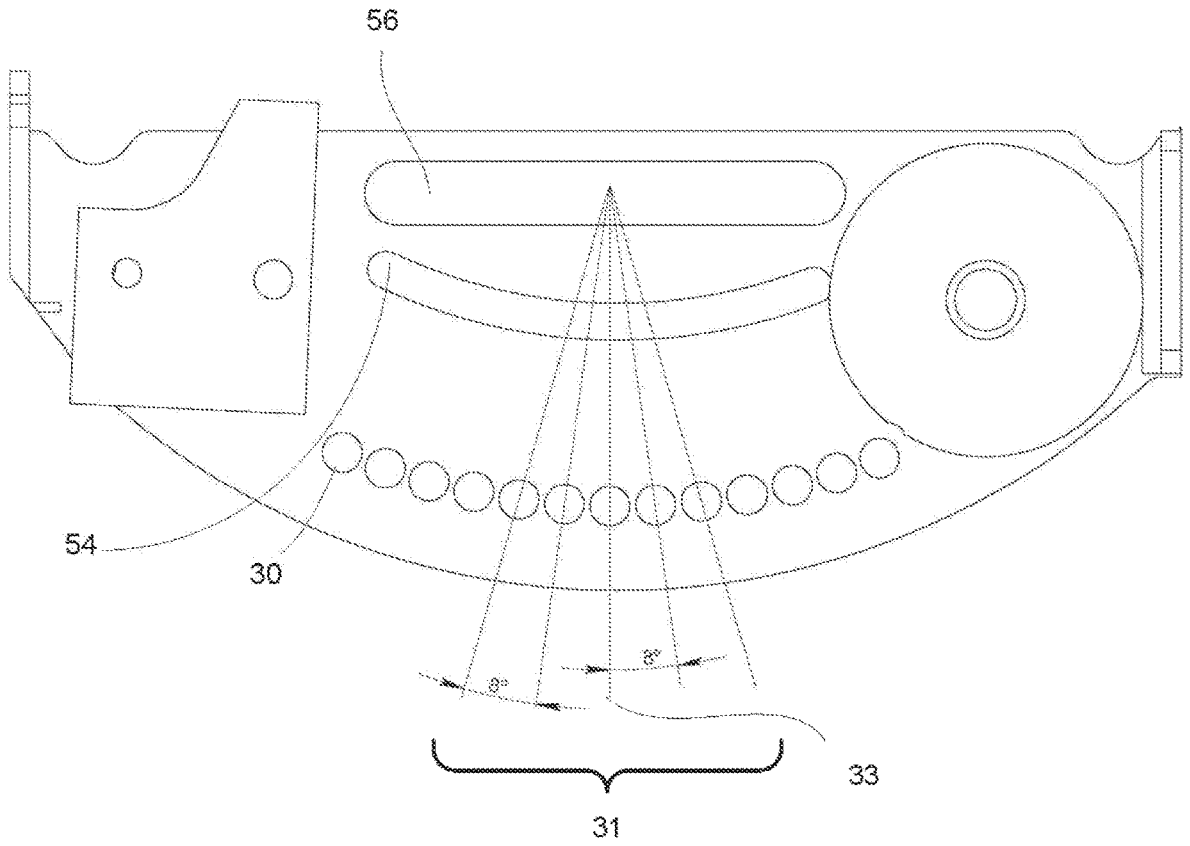
FIG. 11 is a side view drawing illustrating one embodiment of lever angles for a zip line trolley.

FIG. 11 is a side view drawing illustrating one embodiment of lever angles 31 for the zip line trolley 10. In the depicted embodiment, lever angles 31 are shown for a rotatable lever 35 (not shown) connected to the upper sliding bar 69 (not shown) in the upper sliding groove 56, the lower sliding bar 67 (not shown) in the lower sliding groove 54, and plunger pins 71 (not shown) in the lever points 30, with the plunger pins 71 determining the lever angles 31. In the depicted embodiment, the lever angles 31 are separated by 8°. Any combination of lever angles 31 may be provided. Table 1 shows normalized brakes forces for exemplary braking angles 31 measured from a baseline angle 33.

TABLE 1

| Lever Angle 31 (degrees) | Normalized Braking Force |
|---|---|
| 35.7 | 1 |
| 35.0 | 1.015725025 |
| 34.0 | 1.037466882 |
| 33.0 | 1.060356854 |
| 32.0 | 1.080765615 |
| 31.0 | 1.102280187 |
| 30.1 | 1.121305045 |
| 29.0 | 1.143753168 |
| 28.0 | 1.163685074 |
| 27.0 | 1.184609043 |
| 26.0 | 1.203033626 |
| 23.0 | 1.259361973 |
| 22.0 | 1.27801731 |
| 21.0 | 1.29531478 |
| 20.0 | 1.312342263 |
| 19.0 | 1.329082816 |
| 18.0 | 1.345519627 |
| 17.0 | 1.361636069 |
| 16.0 | 1.377415744 |
| 15.0 | 1.392842532 |
| 14.0 | 1.406970608 |
| 13.0 | 1.421669081 |
| 12.0 | 1.435969403 |
| 11.0 | 1.449001414 |
| 10.0 | 1.461659132 |
| 9.0 | 1.474735605 |
| 8.0 | 1.486585022 |
| 7.0 | 1.498027507 |
| 6.0 | 1.50977348 |
| 5.2 | 1.518265324 |

The braking force is thus a function of the braking angle 31. The braking angle 31 can be adjusted to match the slope of the cable 45, with more braking force applied for steeper slopes of the cable 45. In addition, the braking force is dynamically modified as the slope of the cable 45 changes. For example, for any braking angle 31, the braking force is increased for a steeper slope of a first portion of the cable 45 and the braking force is decreased for a shallower slope for a second portion of the cable 45. As a result, the braking force dynamically adjusts to the slope of the cable 45.

Figure 12:
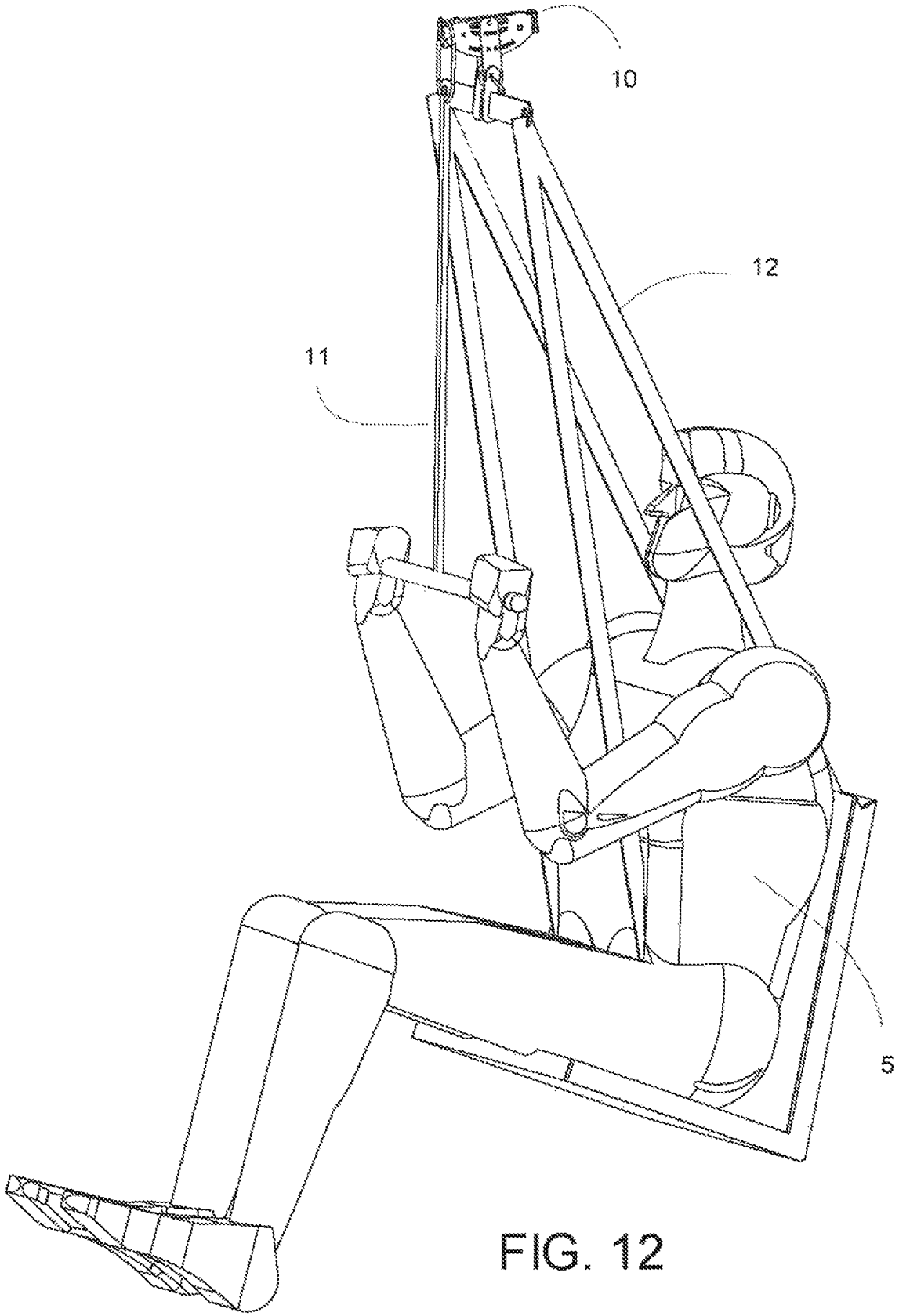
FIG. 12 is a perspective drawing illustrating one embodiment of a rider suspended below a zip line trolley with an active brake.

FIG. 12 is a perspective drawing illustrating one embodiment of the rider 5 suspended below a zip line trolley 10 with an active brake 11. In the depicted embodiment, the rider 5 is disposed in a harness 12. In addition, the rider 5 holds the active brake 11. The active brake 11 may be a rope, a cable, structure, and the like. The rider 5 may pull down on the active brake 11 to apply the active braking force 46 to the brake 25 and increase the fricative resistance of the brake 25 on the cable 45. As a result, the rider 5 can actively further slow the zip line trolley 10.

Figure 13:
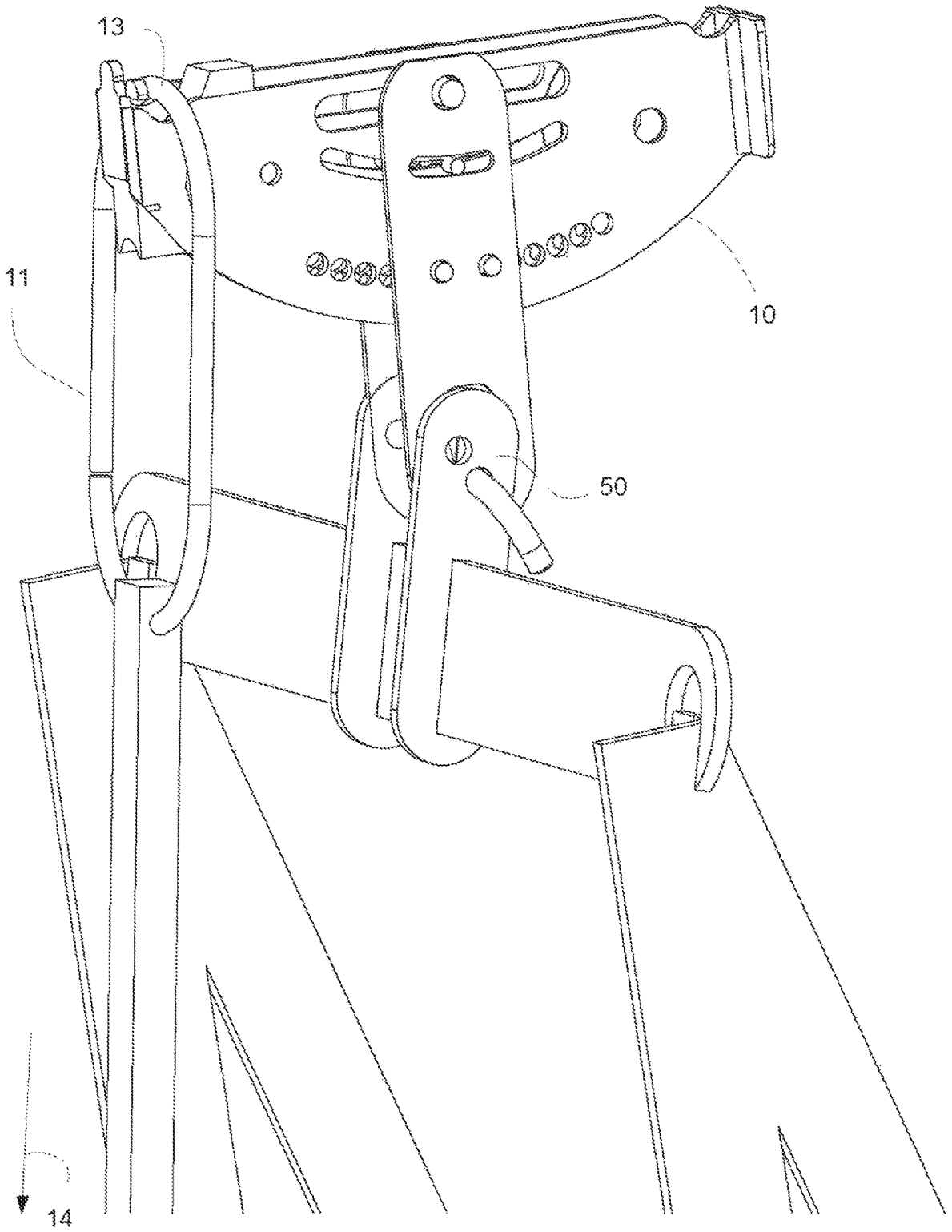
FIG. 13 is a perspective drawing illustrating one embodiment of a zip line trolley with an active brake.

FIG. 13 is a perspective drawing illustrating one embodiment of the zip line trolley 10 with the active brake 11. In the depicted embodiment, a proximal active brake 13 passes through the active brake groove 43. As a result, when the rider 5 pulls on the active brake 11 in an active brake direction 14, the active braking force 46 is applied to the brake 25, increasing the fricative braking force of the brake 25.

Figure 14:
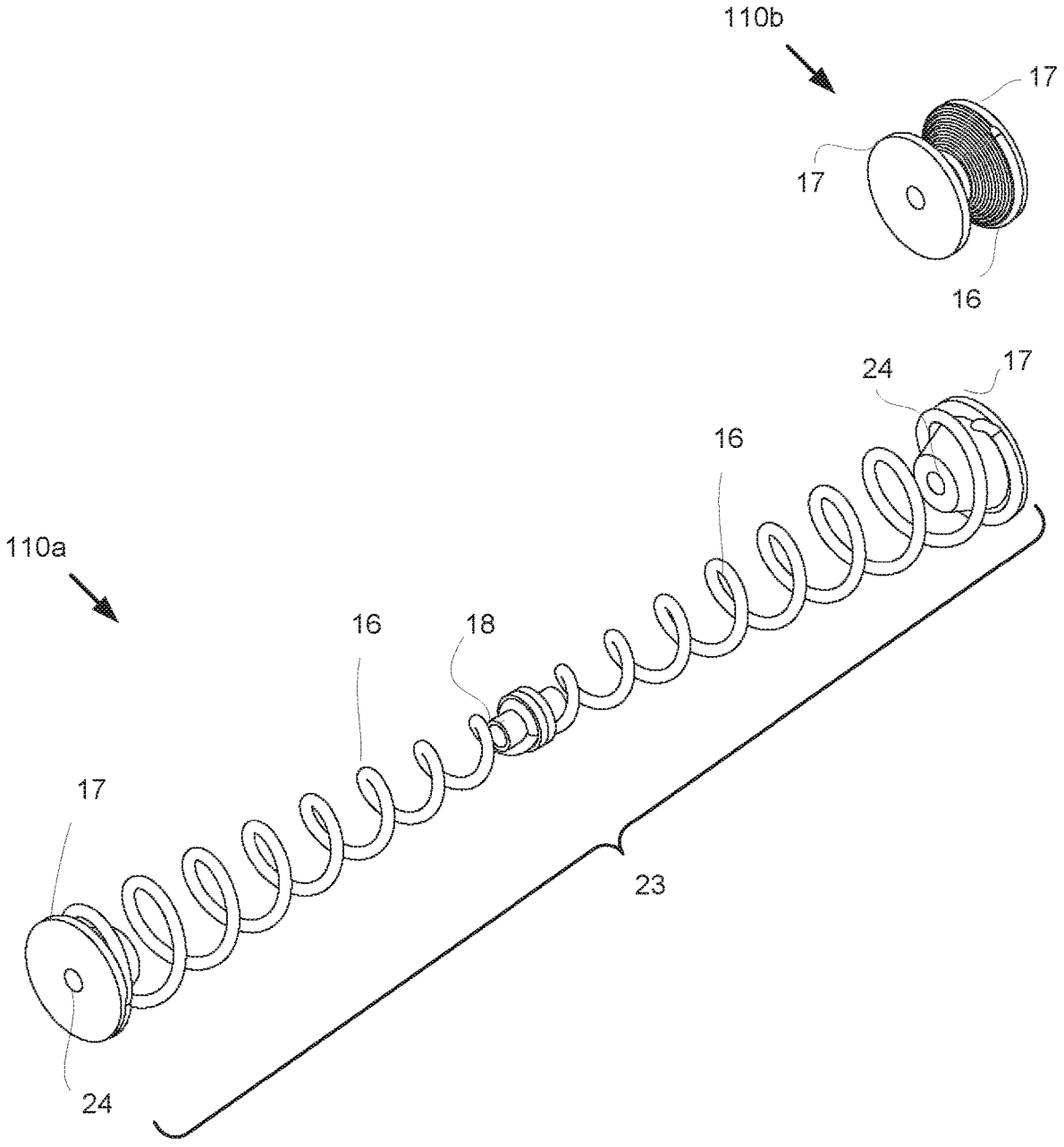
FIG. 14 is a perspective drawing illustrating one embodiment of a spring.
Figure 22:
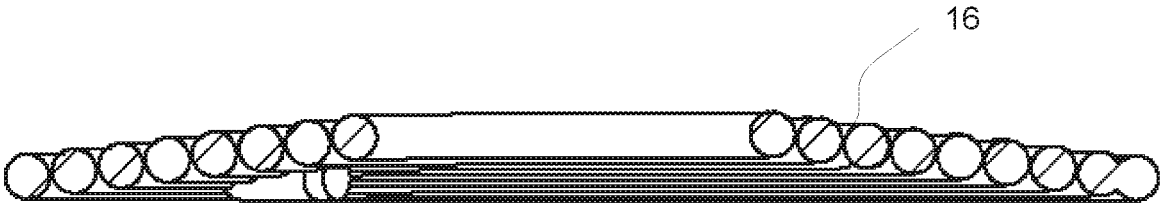
FIG. 22 is a side view cutaway drawing illustrating one embodiment of a spring.

FIG. 14 is a perspective drawing illustrating one embodiment of a spring 110. In the depicted embodiment, an uncompressed spring 110*a* and a compressed spring 110*b* are shown for one spring segment 23. A spring segment 23 may include spring coils 16, one or more end caps 17, and a spring spacer 18. In one embodiment, the spring coils 16 may be formed as a single helical hourglass. Alternatively, the spring coils 16 may be formed as two helical cones. The spring coils 16 may have a slope such that when the spring segment 23 is compressed, each spring coils 16 nests within a neighboring spring coils 16 as shown in FIG. 22. As a result, the spring segment 23 may be compressed from a long length to a short length.

In one embodiment, the spring spacer 18 connects two helical cone spring coils 16. In addition, the spring spacer 18 may glide on the cable 45 through the center of the spring segment 23. The end caps 17 may terminate the spring coils 16. In one embodiment, the cable 45 passes through a hole 24 in each end cap 17. The hole 24 may receive a portion of the brake stop angled tab hitch 27 to increase the braking force.

The spring segment 23 comprises a plurality of spring coils 16. The brake stop angled tab hitch 27 contacts the spring segment 23 and compresses the spring segment 23. In one embodiment, an end cap 17 of the spring segment 23 contacts the brake stop angled tab hitch 27. The brake stop angled tab hitch 27 may compress the spring coils 16 of the spring segment 23. The spring coils 16 of the compressed spring segment 23 may nest completely within a neighboring spring coil 16.

Figure 15:
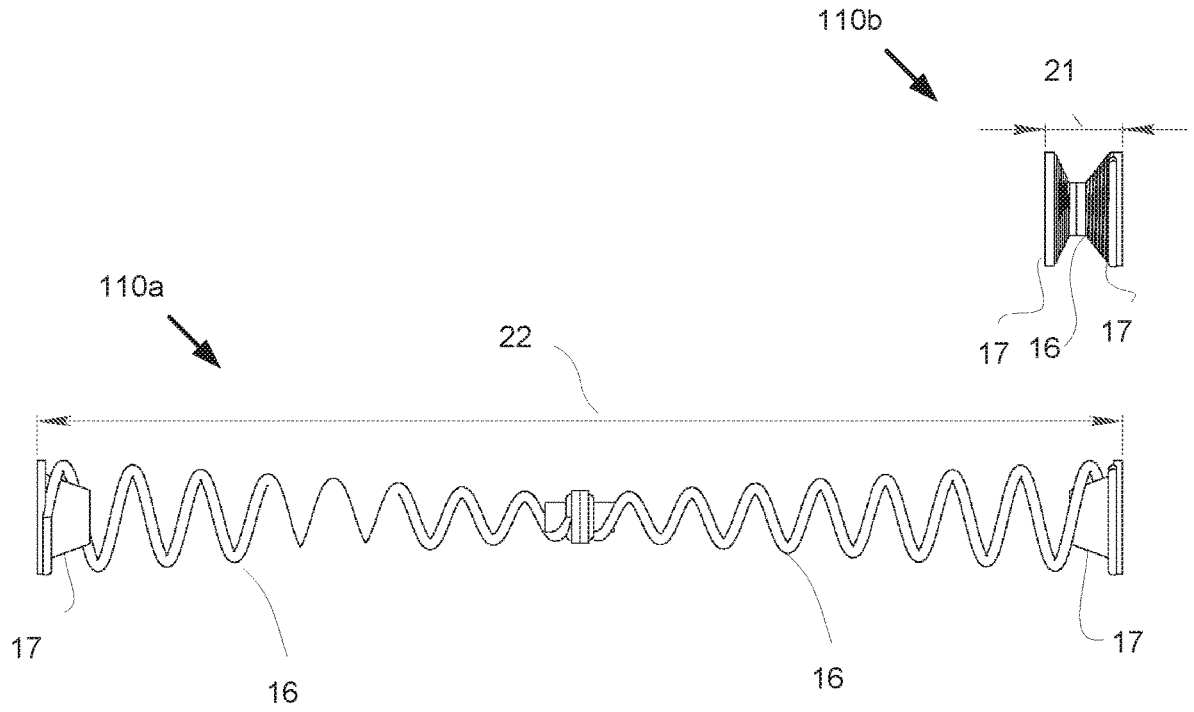
FIG. 15 is a side view drawing illustrating one embodiment of a spring.

FIG. 15 is a side view drawing illustrating one embodiment of the spring 110 of FIG. 14. In the depicted embodiment, one spring segment 23 has an uncompressed length 22. The uncompressed length 22 may be in the range of 2 to 6 inches. In addition, the spring segment 23 has a compressed length 21. The compressed length 21 may be in the range of 0.5 to 2.25 inches.

Figure 16:
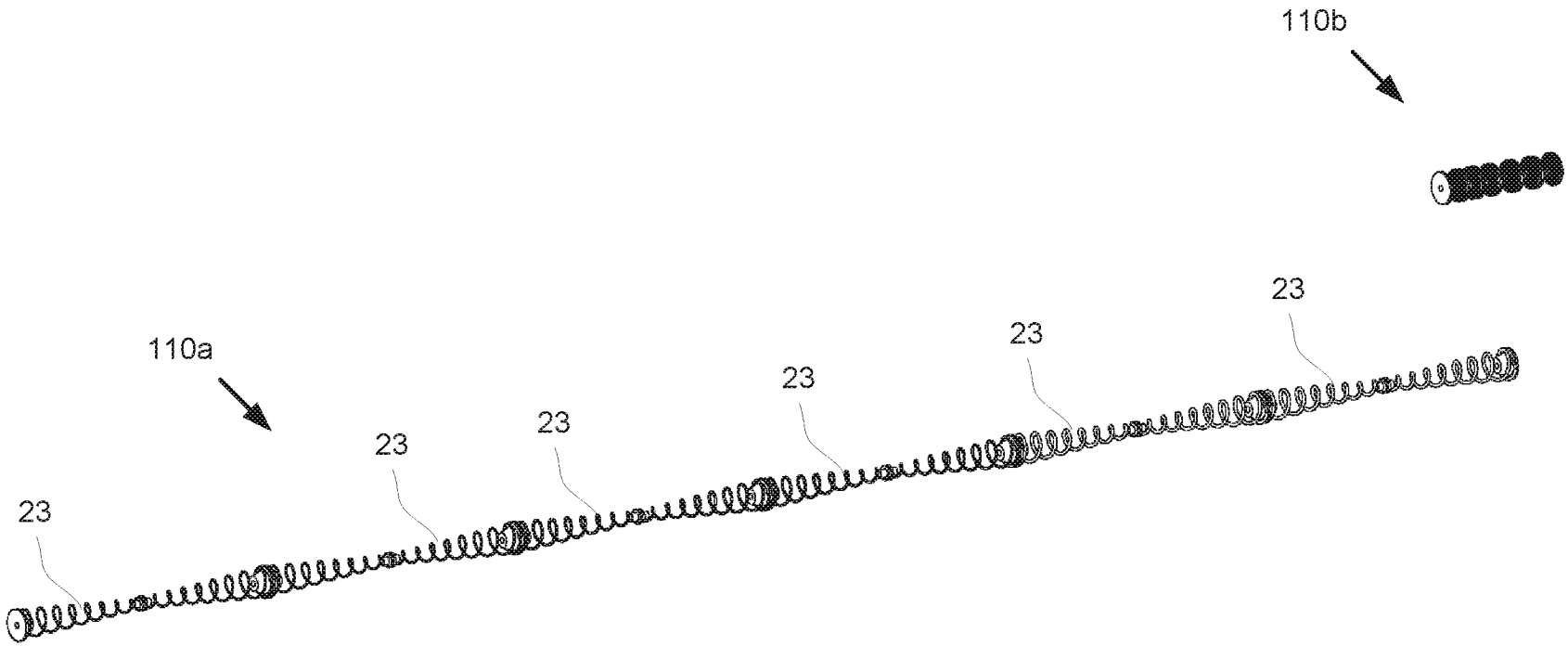
FIG. 16 is a perspective drawing illustrating one embodiment of a spring.

FIG. 16 is a perspective drawing illustrating one embodiment of a spring 110. In the depicted embodiment, the spring 110 is shown as a compressed spring 110*b* and an uncompressed spring 110*a*. The spring 110 includes a plurality of spring segments 23.

Figure 17:
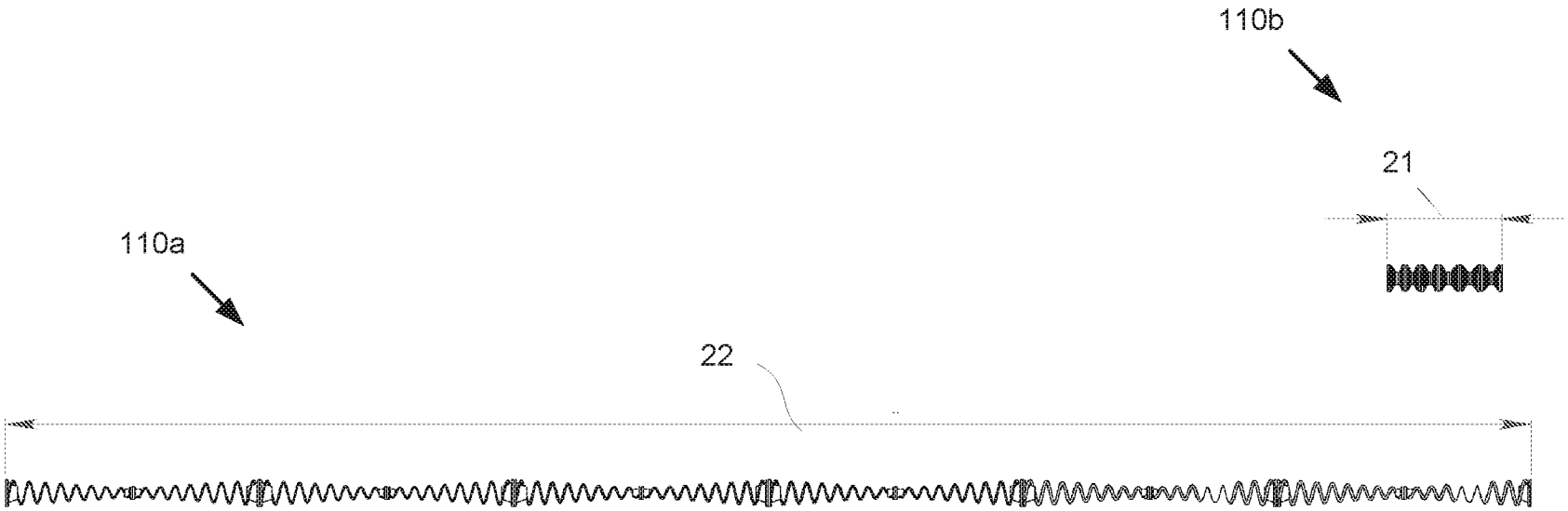
FIG. 17 is a side view drawing illustrating one embodiment of a spring.

FIG. 17 is a side view drawing illustrating one embodiment of the spring 110 of FIG. 16. The uncompressed spring 110*a* may have an uncompressed length 22 in the range of 16 to 20 feet. In addition, the compressed spring 110*b* may have a compressed length 21 in the range of 1 to 2 feet.

Figure 18:
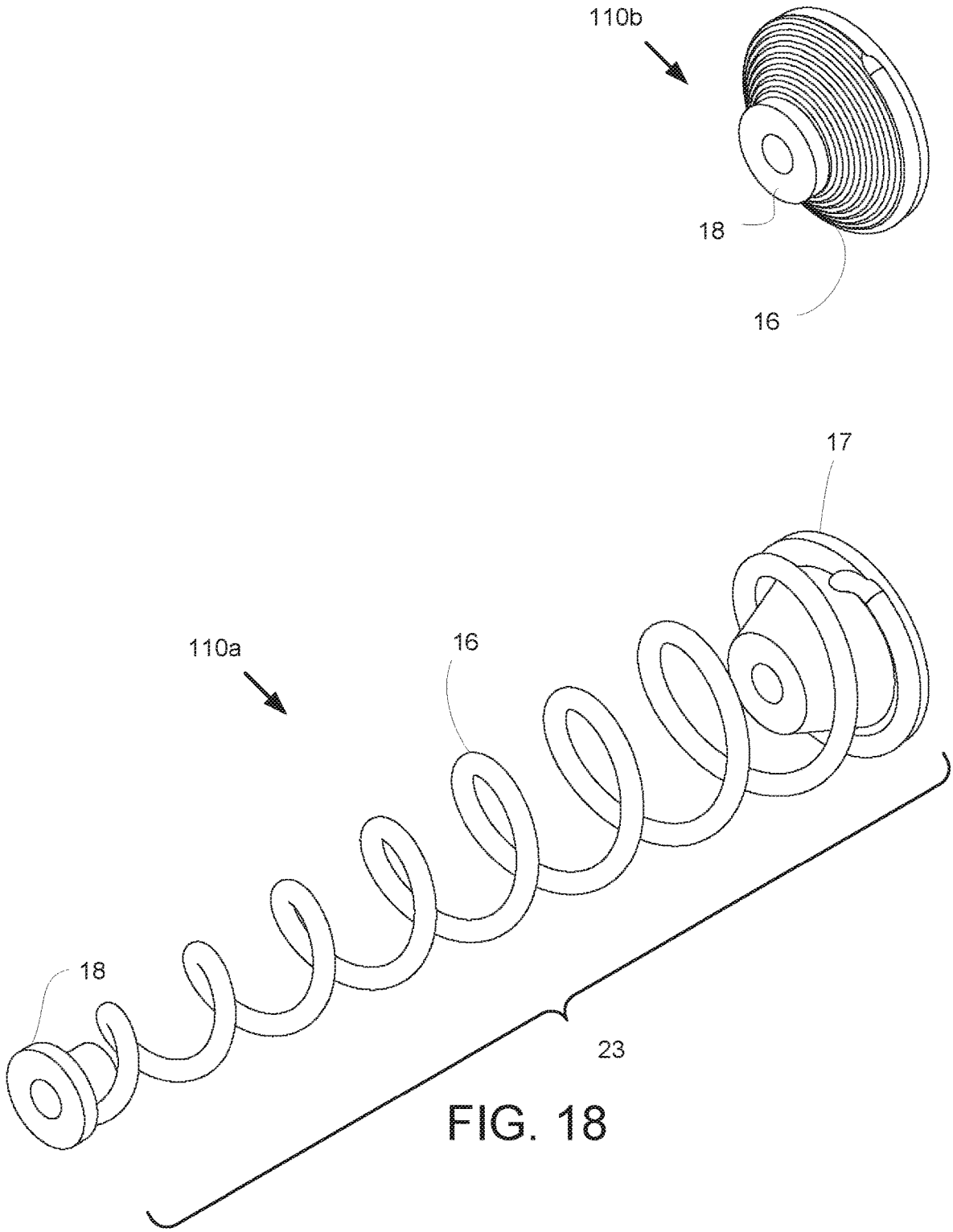
FIG. 18 is a perspective drawing illustrating one embodiment of a spring.

FIG. 18 is a perspective drawing illustrating one embodiment of a spring 110. In the depicted embodiment, a spring segment 23 includes a single helical cone of spring coils 16. The spring 110 is shown as an uncompressed spring 110*a* and a compressed spring 110*b*.

Figure 19:
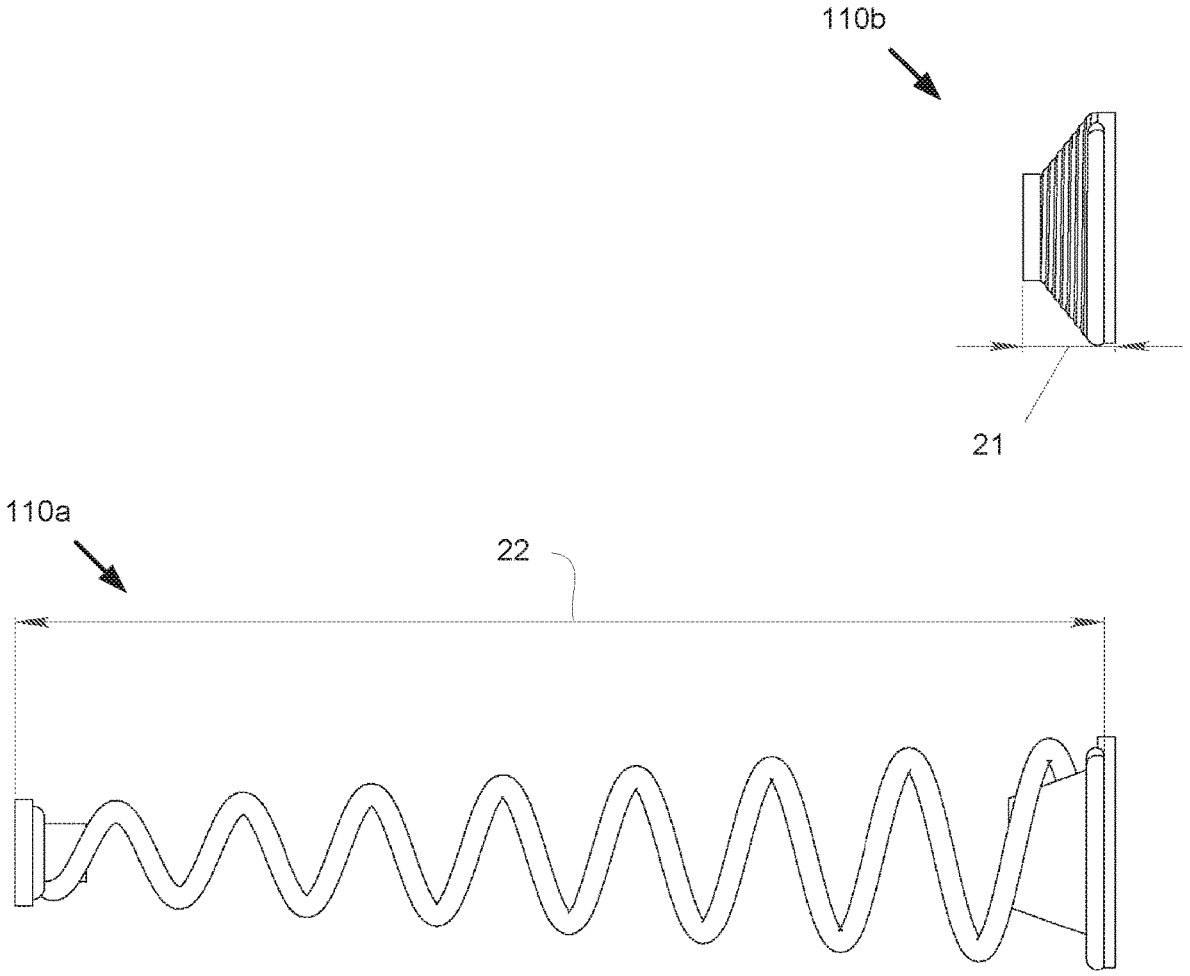
FIG. 19 is a side view drawing illustrating one embodiment of a spring.

FIG. 19 is a side view drawing illustrating one embodiment of the spring 110 of FIG. 18. The uncompressed spring 110*a* has an uncompressed length 22. The uncompressed length 22 may be in the range of 1 to 4 inches. The compressed spring 110*b* has a compressed length 21. The compressed length 21 may be in the range of 0.5 to 1.5 inches.

Figure 20:
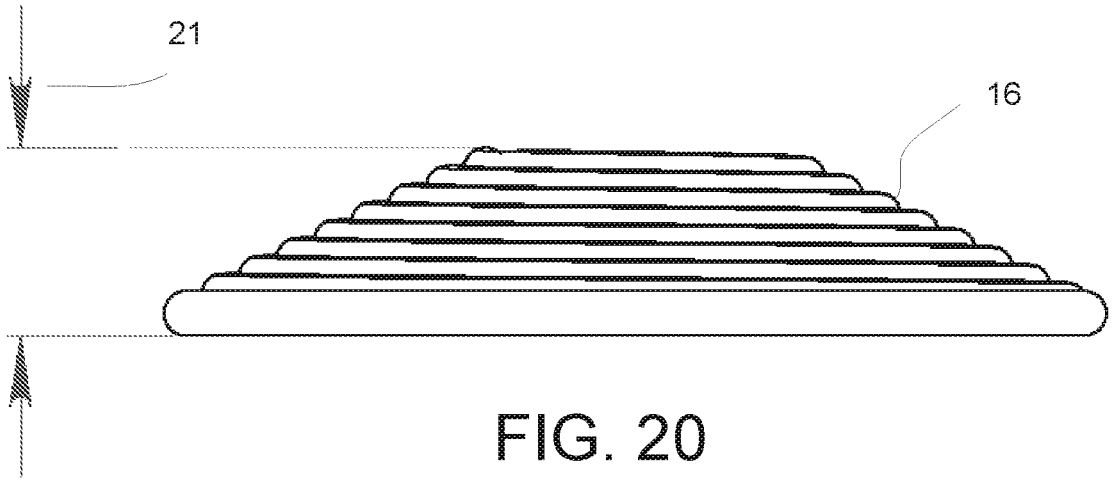
FIG. 20 is a side view drawing illustrating one embodiment of a spring.

FIG. 20 is a side view drawing illustrating one embodiment of the spring coils 16 of a compressed spring 110*b* with the compressed length 21.

Figure 21:
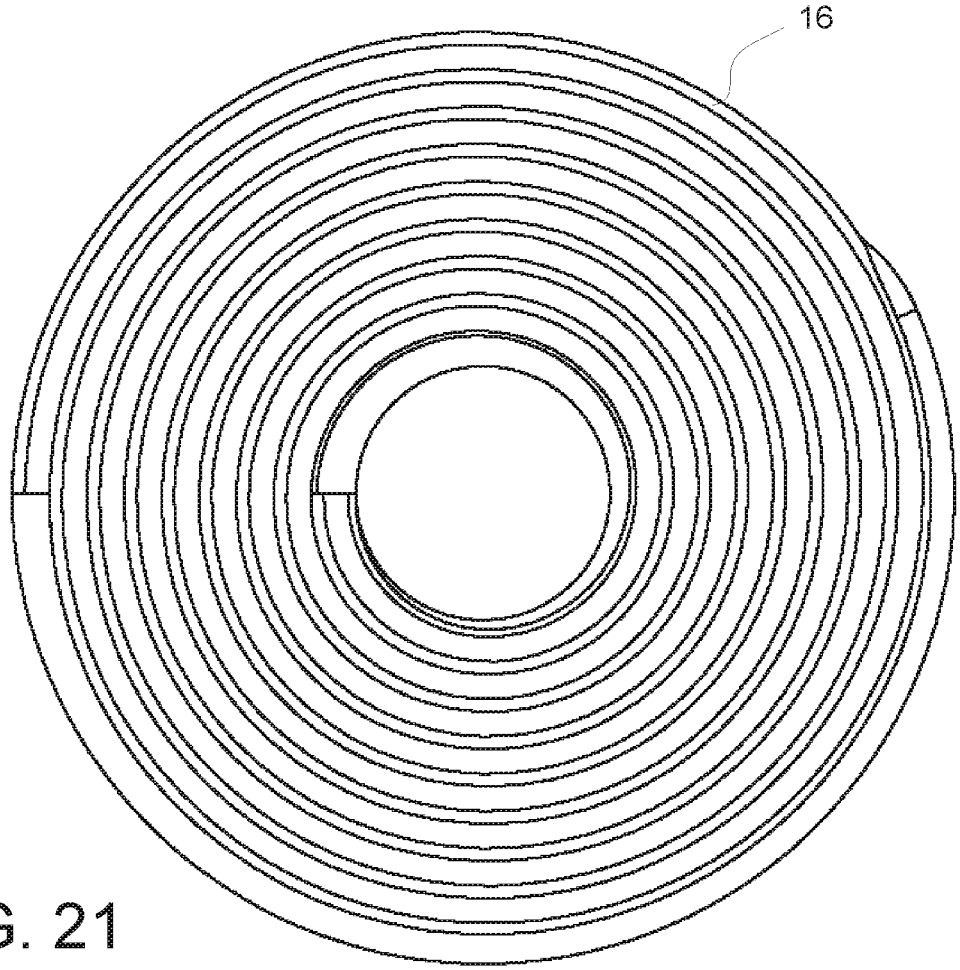
FIG. 21 is a top view drawing illustrating one embodiment of a spring.

FIG. 21 is a top view drawing illustrating one embodiment of the spring coils 16 of the compressed spring 110*b* of FIG. 20.

FIG. 22 is a side view cutaway drawing illustrating one embodiment of a compressed spring 110*b*. In the depicted embodiment, each spring coil 116 of the nests completely within a neighboring spring coil 16. As a result, a spring segment 23 may have a compressed length 21 that is substantially equivalent to a diameter of each spring coil 116. As used herein, substantially equivalent refers to within plus or minus 50%.

Figure 23:
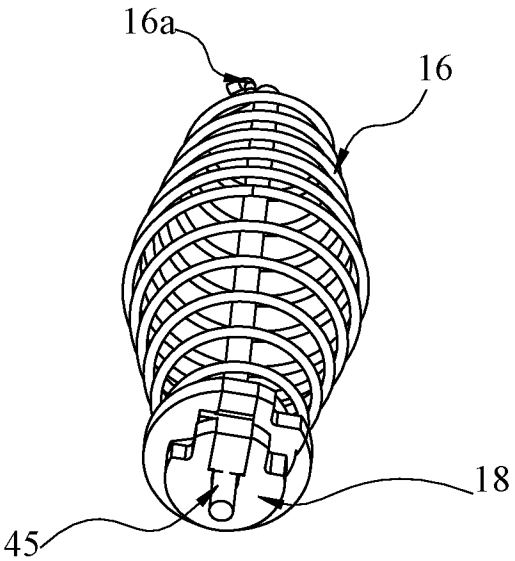
FIG. 23 is a perspective drawing of a spring coil.

FIG. 23 is a perspective drawing of a spring coil 16. The spring spacer 18 is shown on the cable 45.

Figure 24:
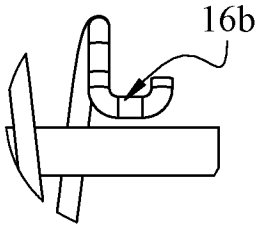
FIG. 24 is a side view drawing of a spring coil end.

FIG. 24 is a side view drawing of a spring coil end 16*b*.

Figure 25:
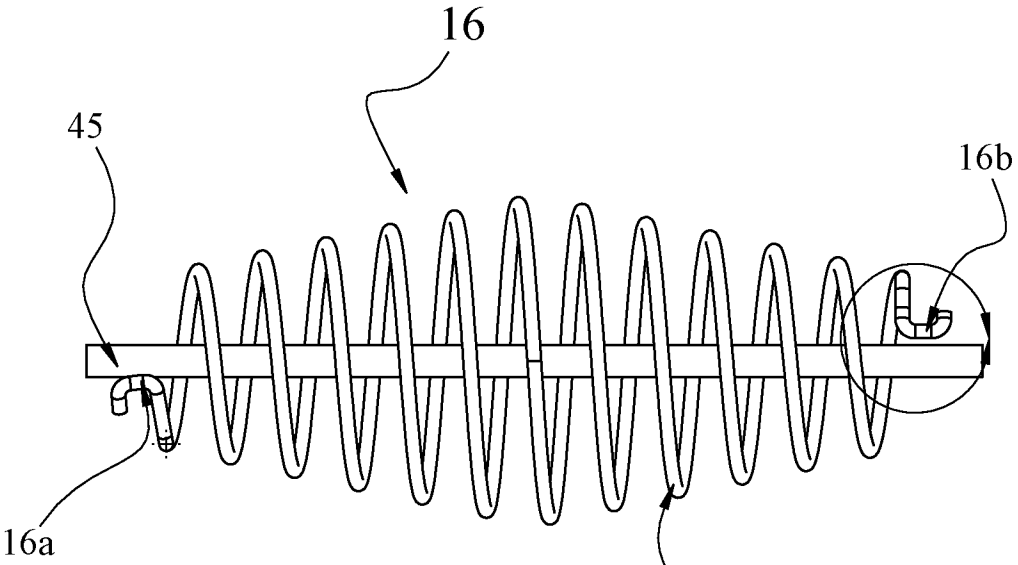
FIG. 25 is a side view drawing of a spring coil.

FIG. 25 is a side view drawing of a spring coil 16. The spring coil ends 16*a/b* are shown.

Figure 26:
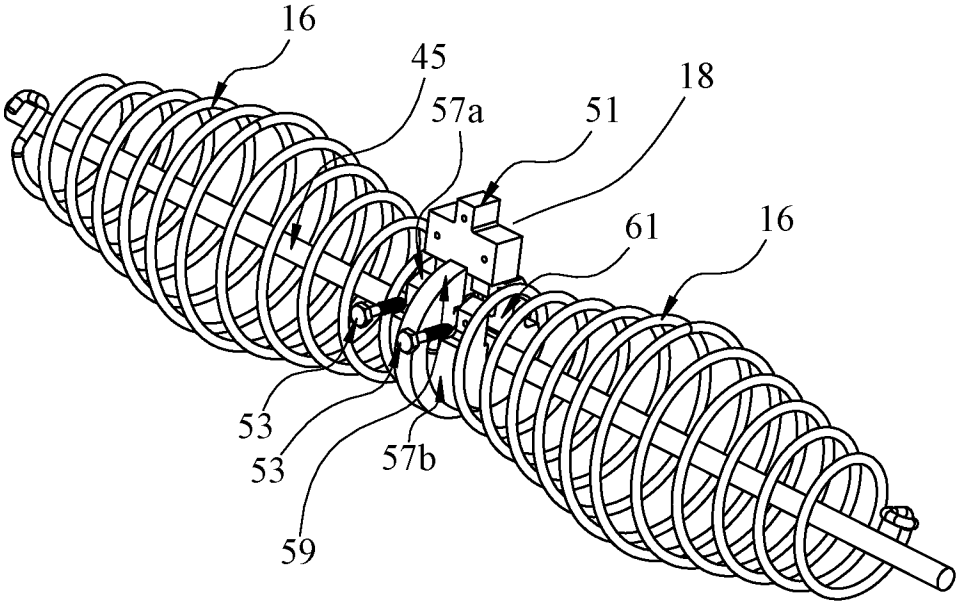
FIG. 26 is a perspective drawing illustrating one embodiment of springs and a spring spacer.

FIG. 26 is a perspective drawing illustrating one embodiment of springs 16 and a spring spacer 18. The springs 16 compress to slow and/or stop a zipline trolley 10. The spring spacer 18 maintains the relative alignment of the spring coils 16 about a central axis and/or cable 45. Thus, as the springs coils 16 compress, the spring coils 16 nest within each other, increasing the effectiveness of the spring coils 16.

The outer diameter of the spring coils 16 may be 5 inches plus or minus 0.5 inches. The spring coils 16 may be in the range of 0.125-0.375 inches (4-10 mm) in diameter and consist of carbon or stainless steel and compress in the range of 25 to 125 lbs.

The spring spacer 18 comprises an inner disc 55 and two outer discs 57. A spring spacer slot 61 is formed from an edge of the inner disc 55 and the two outer discs 57*a* and 57*b*, to the central axis. The spring spacer 18 is fit to a cable 45 with the cable 45 at the central axis. The spring spacer 18 may be formed of Ultra High Molecular Weight Polyethylene.

The spring spacer 18 comprises lock notches 59. Inner ends of two spring coils 16 are rotated independently in the spring spacer slot 61 and disposed in a lock notches 59. An insert lock 51 locks the inner ends of the spring coils 16 as will be shown hereafter. The insert lock 51 may be secured to the spring spacer 18 with lag screws 53.

The compressed spring coils 16 nest partially on the inner disc 55 and around the outer disc 57*a* and 57*b*, nesting completely within a neighboring spring coil 16. The cable 45 passes through the two spring coils 16. In one embodiment, the insert lock 51 seamlessly fills the spring spacer slot 61.

Figure 27:
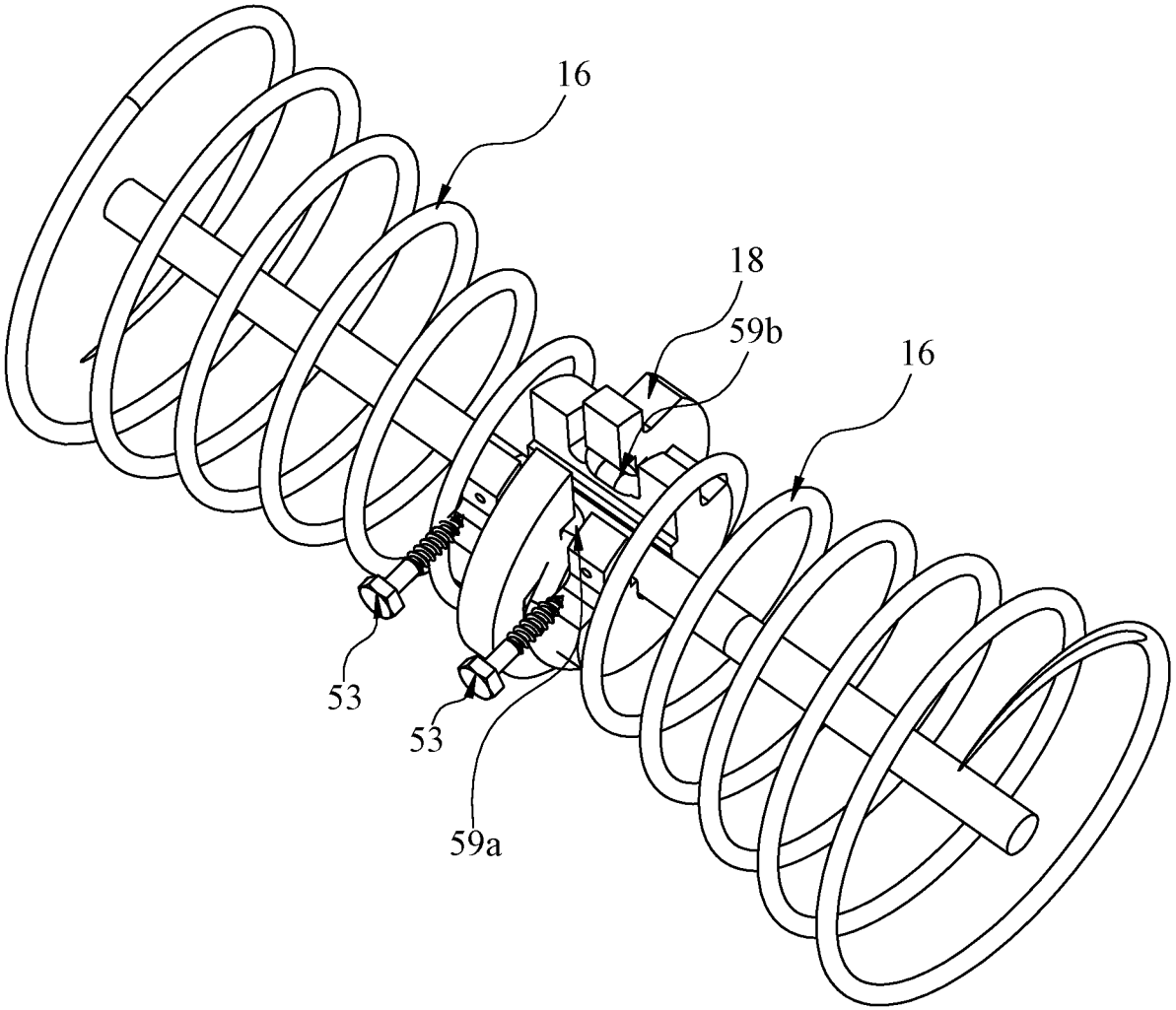
FIG. 27 is a perspective drawing illustrating one embodiment of springs and a spring spacer.

FIG. 27 is a perspective drawing illustrating one embodiment of the springs 16 and the spring spacer 18. In the depicted embodiment, the insert lock 51 is fit into the spring spacer slot 61 and is secured to the spring spacer 18 with the lag screws 53, locking the inner ends of the springs 16 to the spring spacer 18. Lock notches 59*a/b* receive the coil springs 16.

Figure 28:
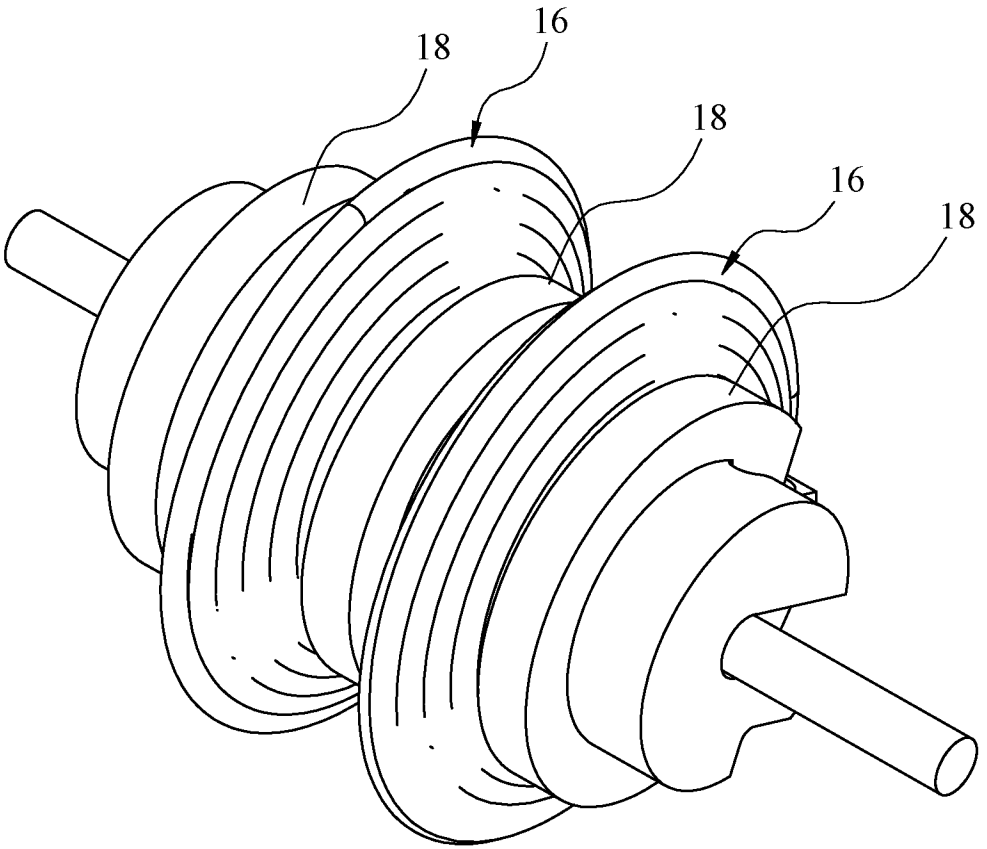
FIG. 28 is a perspective drawing illustrating one embodiment of compressed springs.

FIG. 28 is a perspective drawing illustrating one embodiment of compressed springs 16. The springs 16 are shown compressed with the spring spacer 18 positioning spring coils 16 to nest within neighboring spring coils 16.

Figure 29:
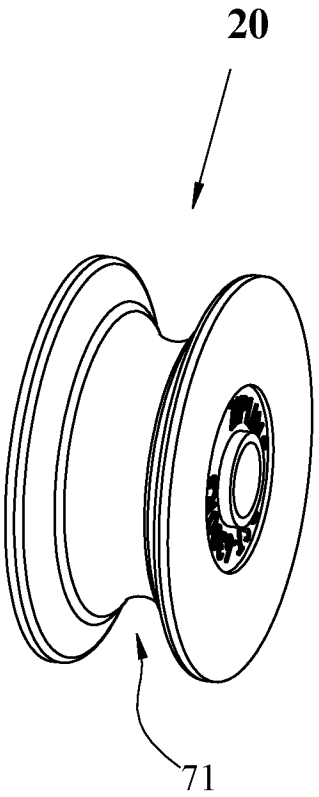
FIG. 29 is a perspective view drawing illustrating one embodiment of a wheel.

FIG. 29 is a perspective view drawing illustrating one embodiment of a wheel 20. The wheel comprises a parabolic grove 71. The parabolic groove 71 supports a plurality of cable sizes. The parabolic opening of the wheel allows the trolley to start on a ⅜-inch cable 45. As the rider moves through the zip tour and the cable 45 is now ⅝-inch diameter (longer zipline runs require larger diameter cable to meet industry safety factors) and longer, the trolley with the parabolic wheel 20 allows the tour guide to keep using the same trolley through the entire zipline tour. One trolley for the entire zipline tour. Example first zip line run may be 1000 ft long and with a ½-inch cable 45, the next zip line run may be 2500 feet and requiring a ⅝-inch cable 45, and the last two zipline runs are 4000 feet long and requiring a ¾ inch diameter cable 45.

Figure 30:
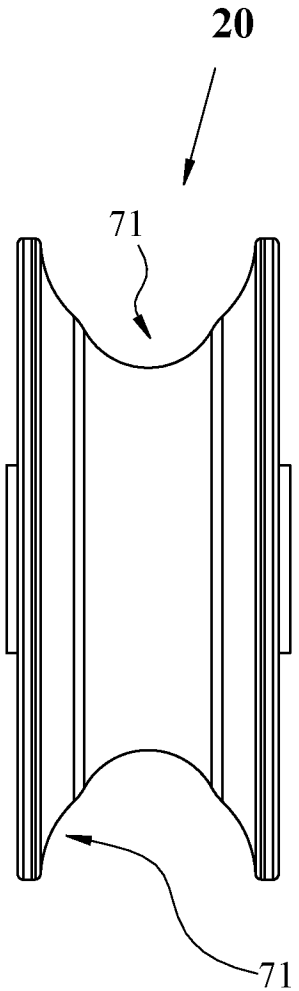
FIG. 30 is a front view drawing illustrating one embodiment of a wheel.

FIG. 30 is a front view drawing illustrating one embodiment of the wheel 20 and the parabolic groove 71.

Figure 31:
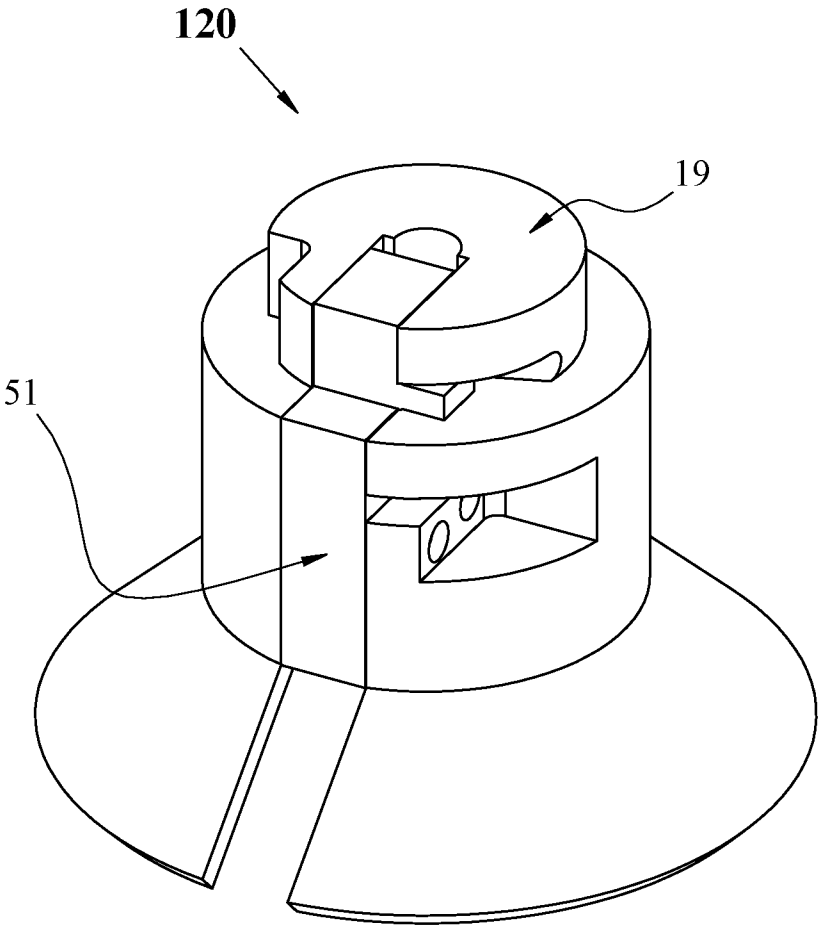
FIG. 31 is a perspective drawing of one embodiment of a wheel.

FIG. 31 is a perspective drawing of one embodiment of the receiver 120. The receiver 120 includes an insert lock 51 and a spring spacer receiver 19. The insert lock 51 retains the receiver 120 on the cable 45.

Figure 32:
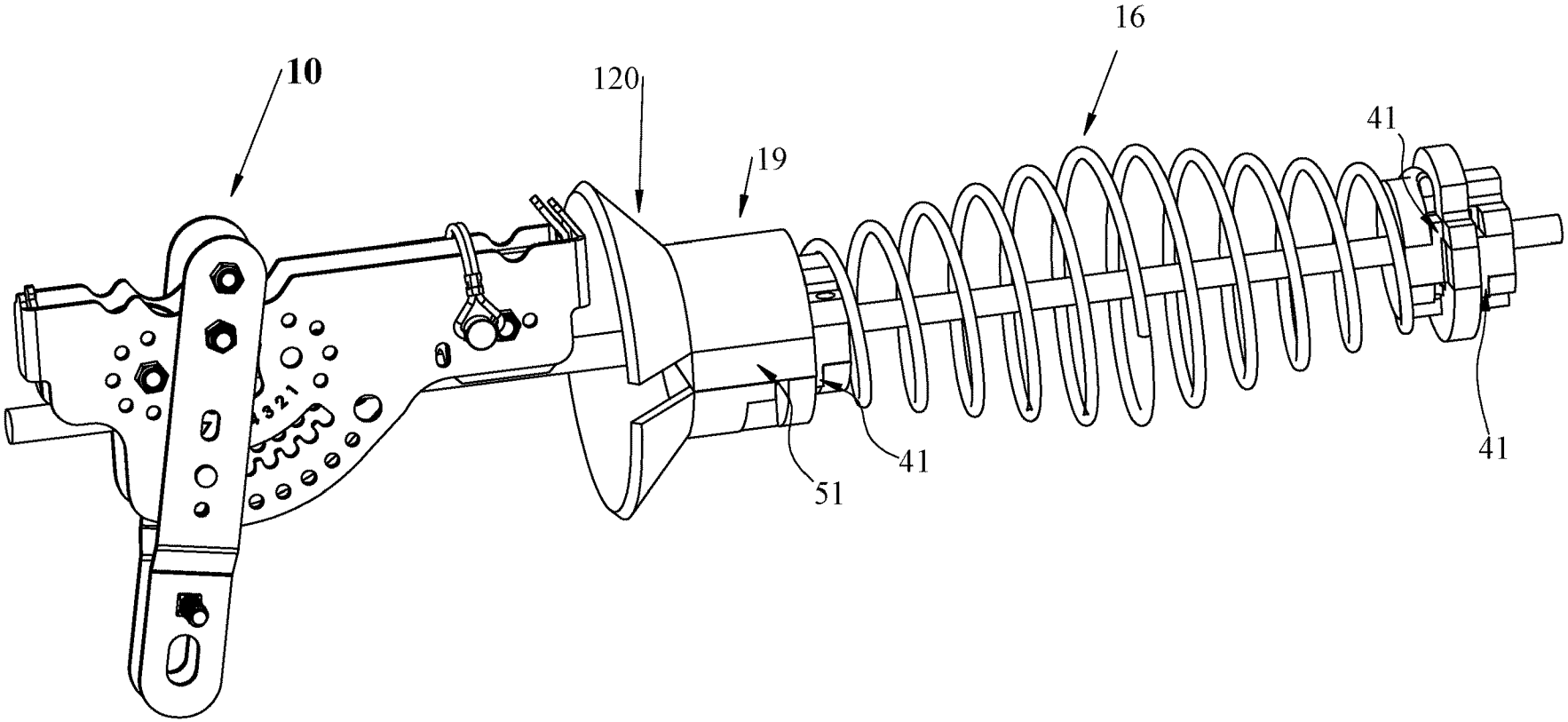
FIGS. 32-34 are perspective drawings of one embodiment of a spring spacer and insert lock.

FIG. 32 is a perspective drawing of one embodiment of the zipline trolley 10 contacting the receiver 120. The spacer insert is shown. The protruding tab 41 holds the spring wire end loop preventing the rotation of the spring and locking the inner end of a spring 16 to the bump spring spacer receiver 19 and the spring spacer 18 may be formed of Ultra High Molecular Weight Polyethylene. The protruding tab 41 may have dimensions of 0.38×–0.22 inches.

Figure 33:
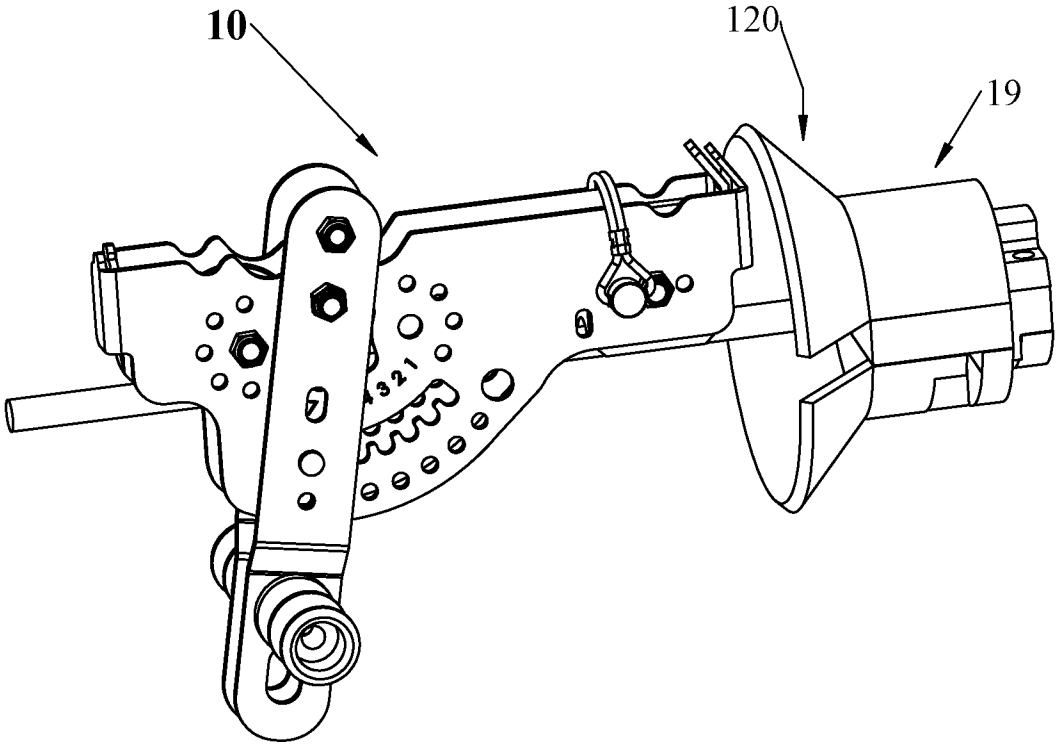

FIG. 33 is a perspective drawing of one embodiment of the zipline trolley 10 contacting the receiver 120 and bump spring spacer receiver 19 perspective drawing views.

Figure 34:
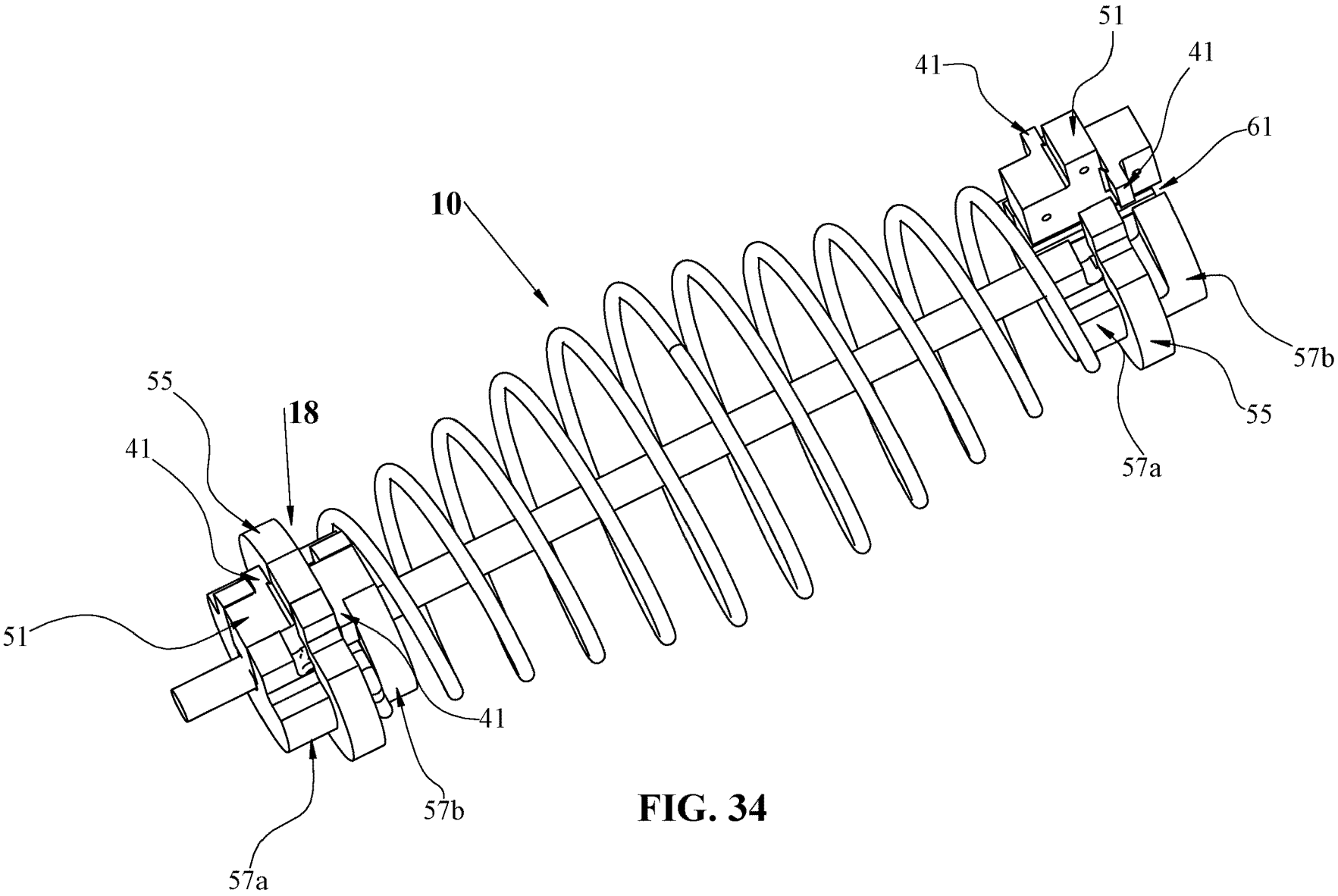

FIG. 34 is a perspective drawing of a spring 16 with one embodiment of a protruding tab 41. The spring spacer 18 comprises an inner disc 55 and two outer discs 57*a* and 57*b*. A spring spacer slot 61 is formed from an edge of the inner disc 55 and the two outer discs 57*a* and 57*b*. The insert lock 51 with protruding tabs 41 holds two spring wire loops preventing the rotation of the spring and locking the inner ends of the springs 16 to the spring spacer 18 may be formed of Ultra High Molecular Weight Polyethylene.

Figure 35:
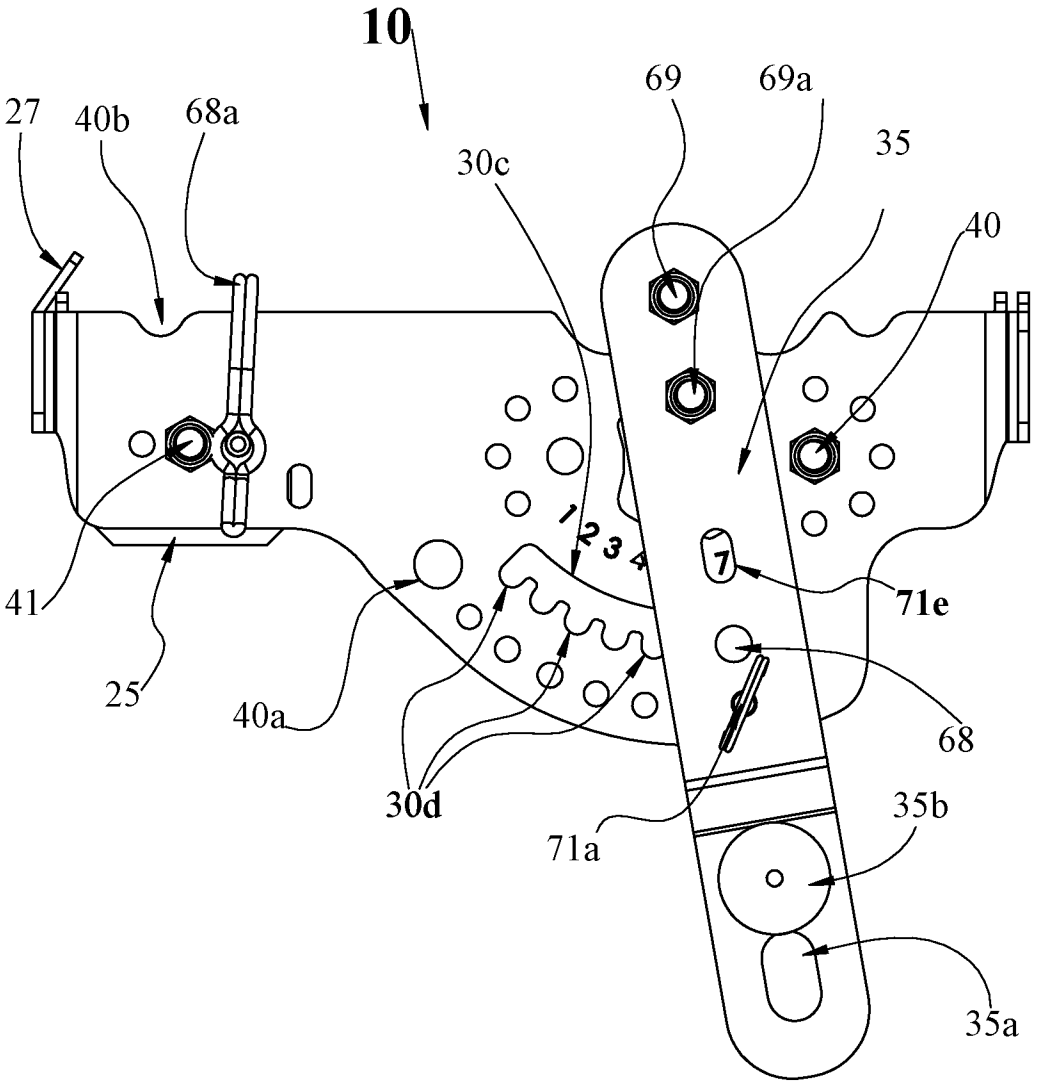
FIG. 35 is a side view cutaway drawing illustrating one embodiment of a zipline trolley.

FIG. 35 is a side view cutaway drawing illustrating one embodiment of a zipline trolley 10. The zipline trolley 10 may convey a rider 5 suspended from a proximal carabiner 50*b* as shown in FIGS. 1 and 2. The zipline trolley 10 may travel along a cable 45 in either direction including both positioning the brake 25 in front of the wheel 20 as shown in FIGS. 1 and 2 and positioning the wheel 20 in front of the brake 25. The fixed short pin 68 in the depicted embodiment locks in a locating number 71*e* for the desired slope of the zipline. Changing the fixed short pin 68 changes the lever angle 31, which modifies the braking force exerted by the brake 25 as described in FIG. 11. The locating number 71*e* includes number positioning of 1-7 in the depicted embodiment, allowing for a visual determination of the zipline slope braking force. Any number of numbering positions may be employed. Positioning the wheel 20 in front changes the braking force of the zipline trolley 10, resulting in a second set of braking forces based on the lever angle 31.

The zipline trolley 10 includes a wheel axle 93, a frame 15, a safety hole 40*a* for inserting the distal carabineer 50*a*, a rotatable lever 35, a square brake 25, a s safety lock pin 71*a* for an array of holes 91, a handle 35*b*, an oval slot 35*a* for a proximal carabineer 50*b* holding the zipline riders weight, the brake stop angled tab angled tab hitch 27, a non-weight bearing safety carabineer groove 40*b*, a top pin 69, and a rotatable lever pin 69*a* that can move vertically up allowing the safety lock pin 71 to be rotated along 30*c* to another location number 71*e* then the lever 35 and rotatable lever pin 69*a* can be moved downward into a toothed pin slot 30*d*. In this view, the zipline trolley 10 lever 35 short pin 68 located in circular toothed slot number seven may apply minimal force on the brake by the suspended rider attached to a proximal carabineer 50*b*. This view also shows the brake stop angled tab hitch 27 which may be forced down upon impact with the spring system receiver 120 to initiate a downward force on the brake 25 causing the zipline trolley to decelerate. This view also shows a safety pin 69 passing through the holes of the rotatable lever 35 and the frame 15.

Figure 36:
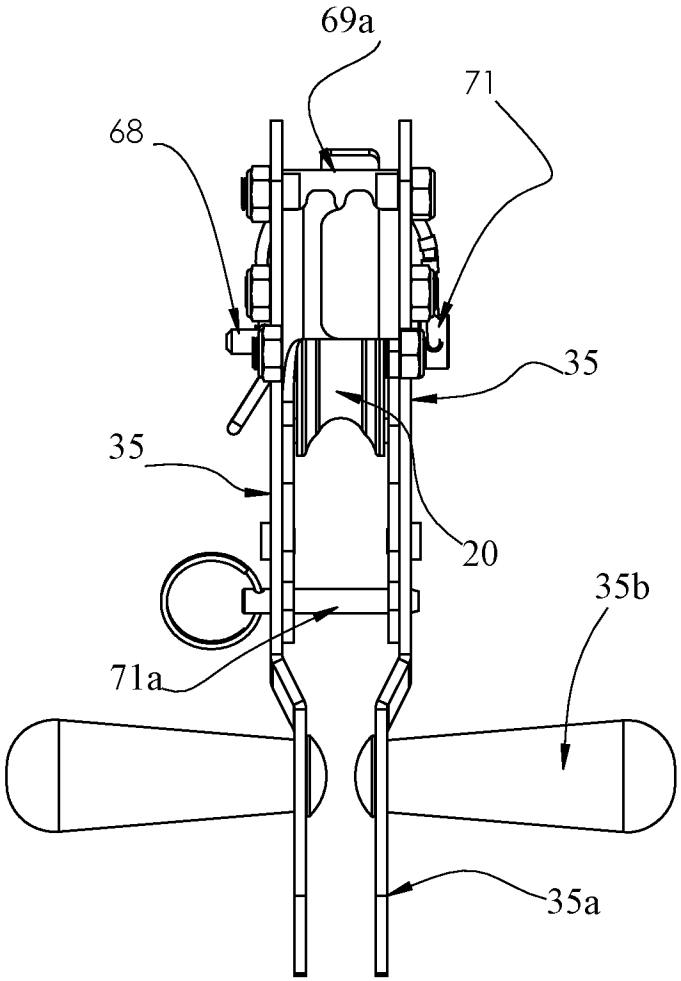
FIG. 36 is a front-view drawing illustrating one embodiment of a zipline trolley.

FIG. 36 is a front view drawing illustrating one embodiment of a zipline wheel 20. The zipline trolley wheel 20 may traverse suspended cables with diameter range 0.375-inch thru 0.75-inch cable 45. The rider is suspended from the proximal carabiner 50*b* (not shown) in a carabineer slot 35*a*. The safety lock pin 71*a* is in a secured position. The handles 35*b* may prevent a rider from spinning.

Figure 37:
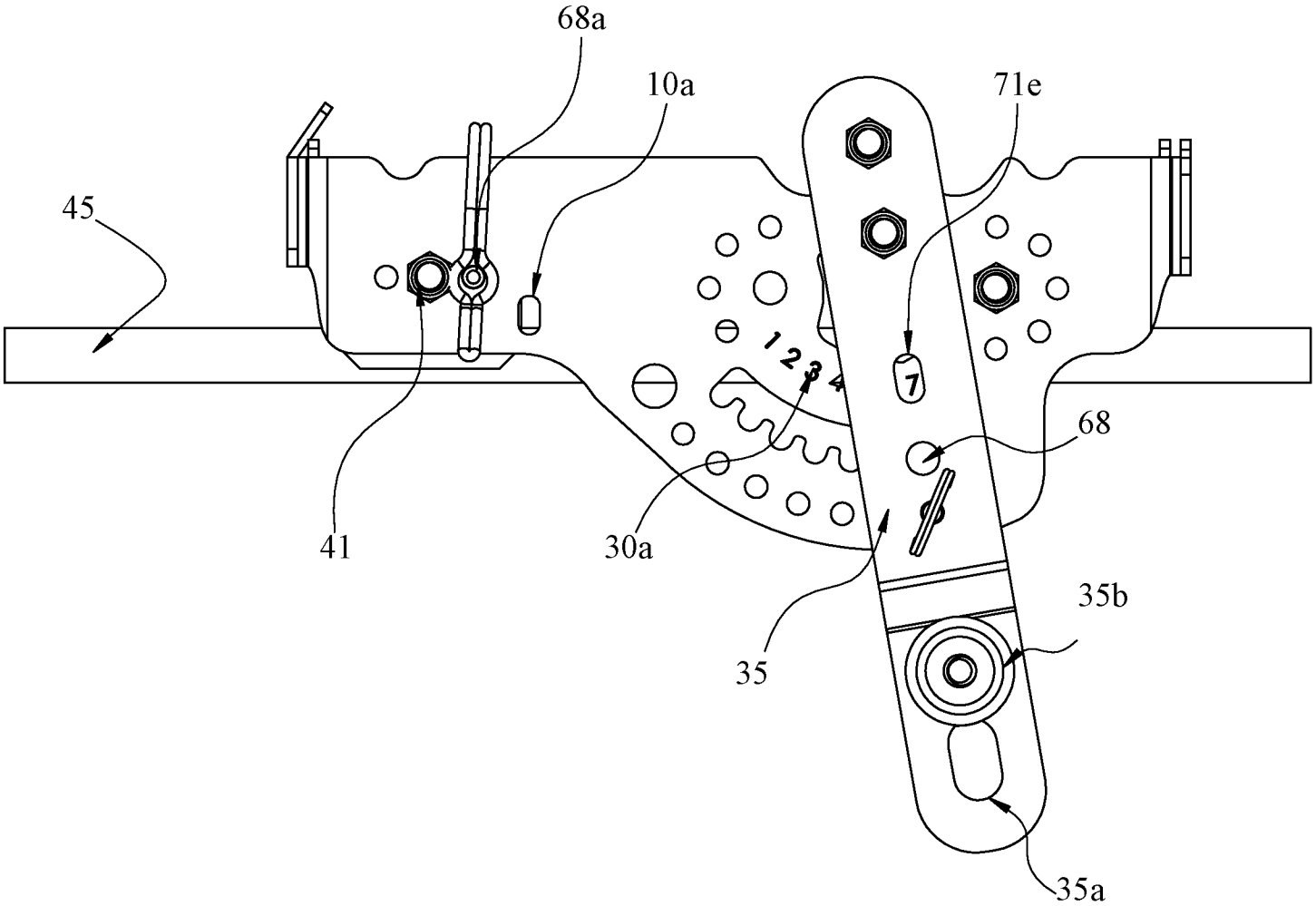
FIG. 37 is a side view cutaway drawing illustrating one embodiment of a zipline trolley and cable.

FIG. 37 is another side view cutaway drawing illustrating one embodiment of a zipline trolley 10 positioned atop a suspended cable 45. The zipline trolley 10 may carry a rider 5 suspended from atop the cable 45 with brake force applied by rotatable lever 35 position seven of the 1-7 numbers with position three 30*a*. The carabineer slot 35*a* suspends the riders' weight.

Figure 38:
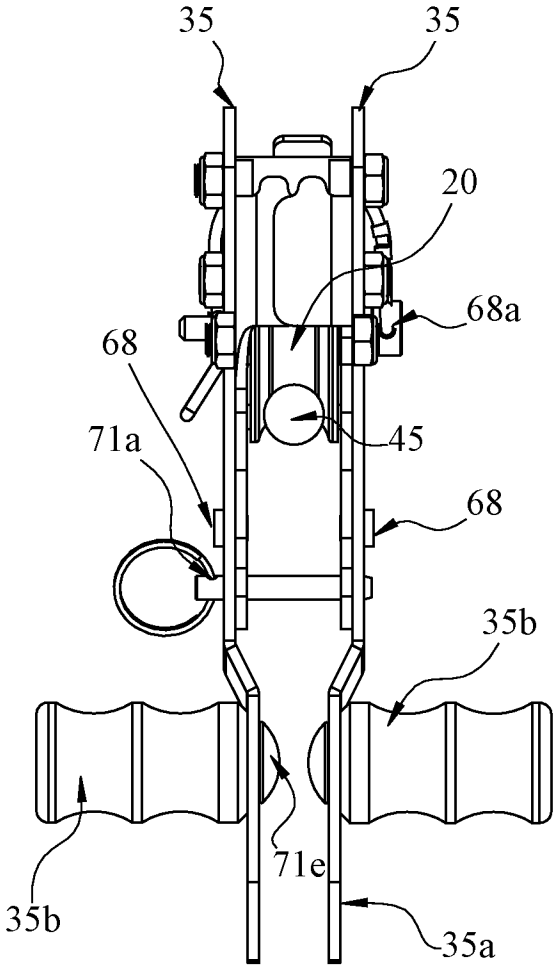
FIG. 38 is a front-view drawing illustrating one embodiment of a zipline trolley and cable.

FIG. 38 is another front view drawing illustrating one embodiment of a zipline wheel 20 and brake 25 rest atop the cable 45. Removing the locating safety lock pin 71*a* allows zipline trolley wheel 20 and brake 25 [not visible] to be suspended atop cables 45 with diameter range 0.375-inch thru 0.75-inch cable.

Figure 39:
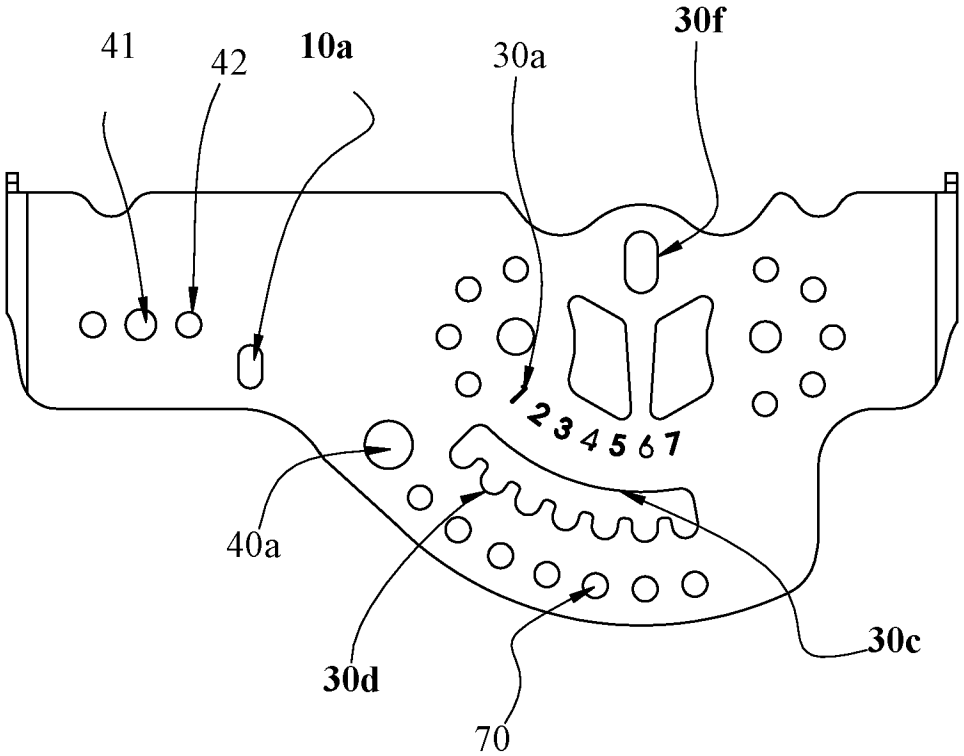
FIG. 39 is a side view drawing illustrating one embodiment of a zipline trolley side plate.

FIG. 39 is an additional side view drawing illustrating one side of a zipline trolley 10. The elongated slot 30*f* allows up and down movement of a pin when making brake force adjustments. The toothed slot 30*c* allows for seven lever 35 placements. Numbering position one 30*a* may allow maximum brake force position of the rider 5 suspended from the lever arm. Numbering position 30*d* is one of seven toothed slots 30*c* providing differing amounts of brake force. A brake pad axle hole 41 and brake locating hole 42 receive the square brake 25 with a bolt circle array of four holes allowing the square brake to be rotated 90 degrees. Slot 10*a* is a sight hole for determining when to rotate the square brake. A curved array of holes 70 receive a safety lock pin for securing the lever 35. Hole 40*a* is for connecting the distal carabineer 50*a*.

Figure 40:
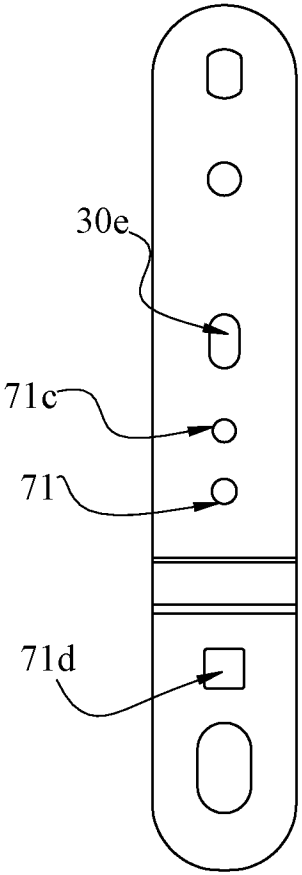
FIG. 40 is a side view drawing illustrating one embodiment of a zipline trolley adjusting side tab.

FIG. 40 is an additional side view drawing illustrating a lever 35. View slot 30*e* is for viewing the force number positioning. Hole 71*c* is for a fixed short pin. Hole 71*e* is for a removable safety lock pin. The square slot 71*d* is for a carriage bolt to secure the handle.

Figure 41:
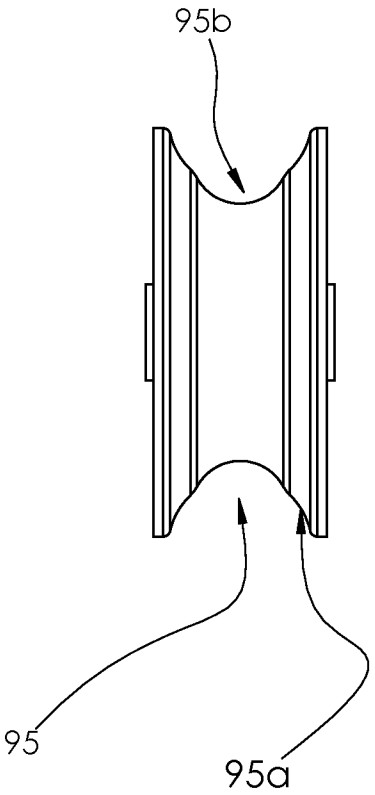
FIG. 41 is a front view drawing illustrating one embodiment of a zipline trolley wheel.

FIG. 41 is an additional front view drawing illustrating the wheel and the parabolic opening 95 with a first surface 95*b* for 0.375 to 0.5-inch cable and a second surface 95*a* for a 0.75-inch curvature. The parabolic opening 95 can accept 0.375-0.75 cable or wire rope.

Figure 42:
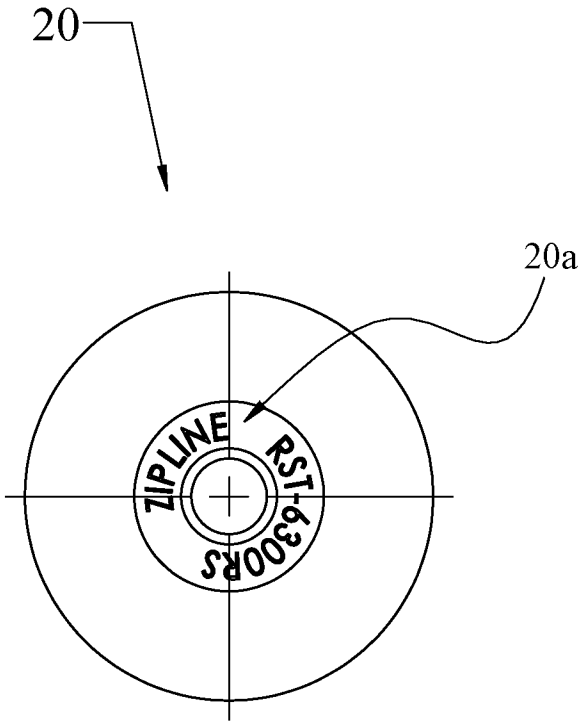
FIG. 42 is a side view drawing illustrating one embodiment of a zipline trolley wheel.

FIG. 42 is an additional side view drawing illustrating a wheel 20 and the sealed roller or Sprag bearing 20*a*.

Figure 43:
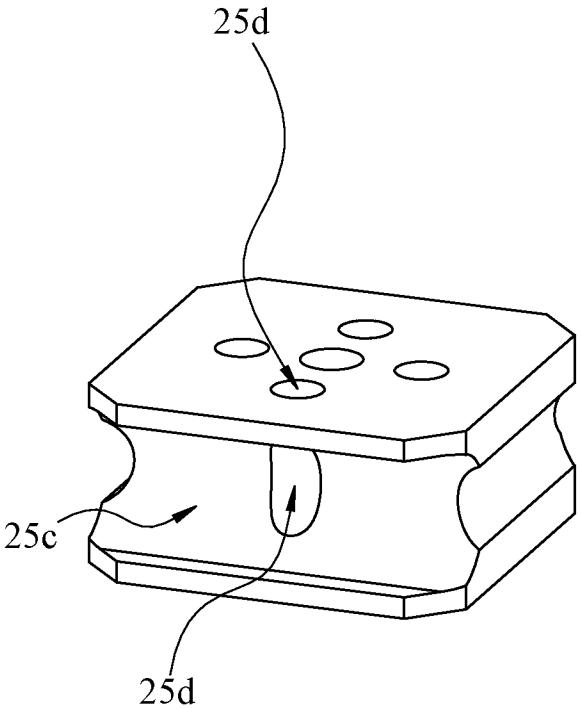
FIG. 43 is a perspective drawing illustrating one embodiment of a zipline trolley rotatable brake pad.

FIG. 43 is an isometric drawing view illustrating a square brake 25 and cutaway 25*a* for positioning the cable 45. The bolt circle 25*b* is for positioning each side of the brake. One side of the brake material has worn through bolt circle hole 25*d*. The worn brake material may be detected through the sight hole 10*a*.

Figure 44:
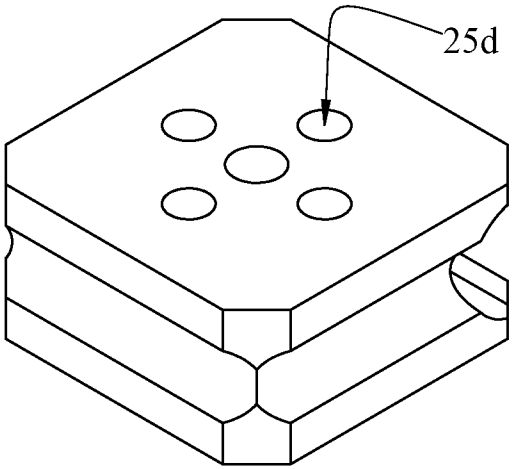
FIG. 44 is a perspective drawing illustrating one alternate embodiment of a zipline trolley rotatable brake pad.

FIG. 44 is another isometric drawing view illustrating a square brake 25.

Figure 45:
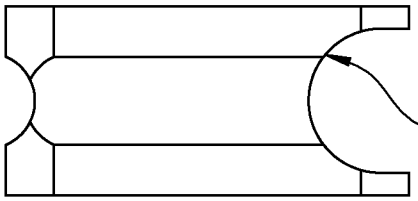
FIG. 45 is a side view drawing illustrating one embodiment of a zipline trolley brake pad.

FIG. 45 is an additional isometric drawing view illustrating a square brake 25 and a cable worn side 25*c*.

Figure 46:
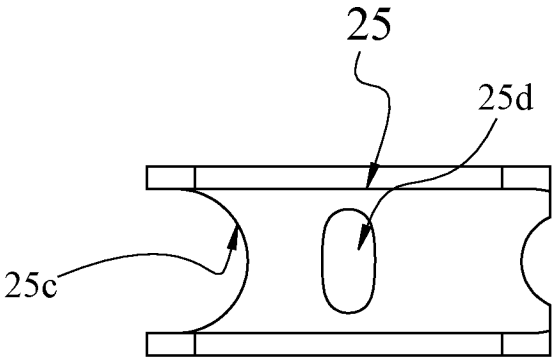
FIG. 46 is a side view drawing illustrating one embodiment of a zipline trolley rotatable worn brake pad.

FIG. 46 is a side view drawing of the brake 25. The brake material is worn 25*c* on two sides exposing the bolt circle hole 25*d*. Hole 25*d* is an indicator to the rider 5 and guide requiring rotation to a new side of the brake 25. The hole 25*d* indicates brake rotation is required as the hole 25*d* is exposed from brake wear.

Figure 47:
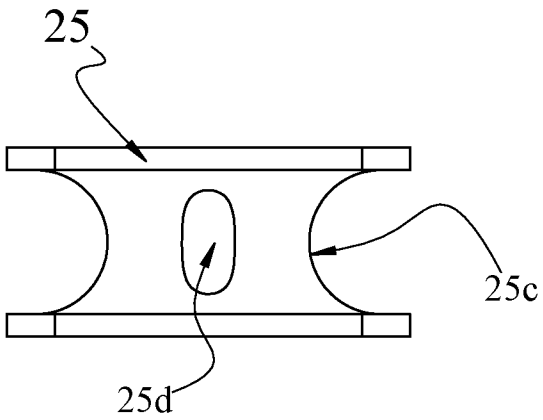
FIG. 47 is a side view drawing illustrating one alternate embodiment of a zipline trolley rotatable worn brake pad.

FIG. 47 is another side view drawing of the brake 25. The brake material is worn 25*c* on three sides exposing the bolt circle hole 25*d*. Hole 25*d* is an indicator to the rider. The indicator 25*d* requires brake rotation to a new brake side or replacing the brake 25 with all new sides.

Figure 48:
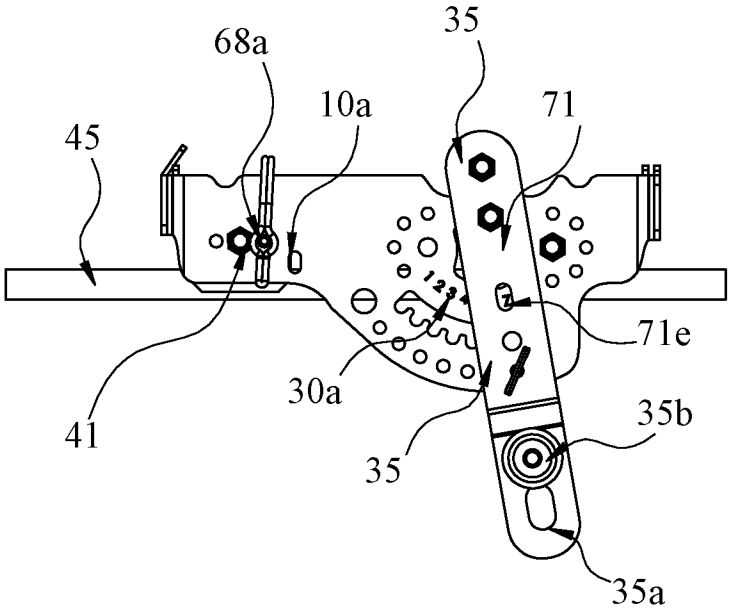
FIG. 48 is a side view drawing illustrating one embodiment of a zipline trolley.

FIG. 48 is a side view drawing illustrating one embodiment of a zipline trolley 10. The brake hole 41, rotatable lever 35, plunger pins 71, and lever points 30 are shown.

Figure 49:
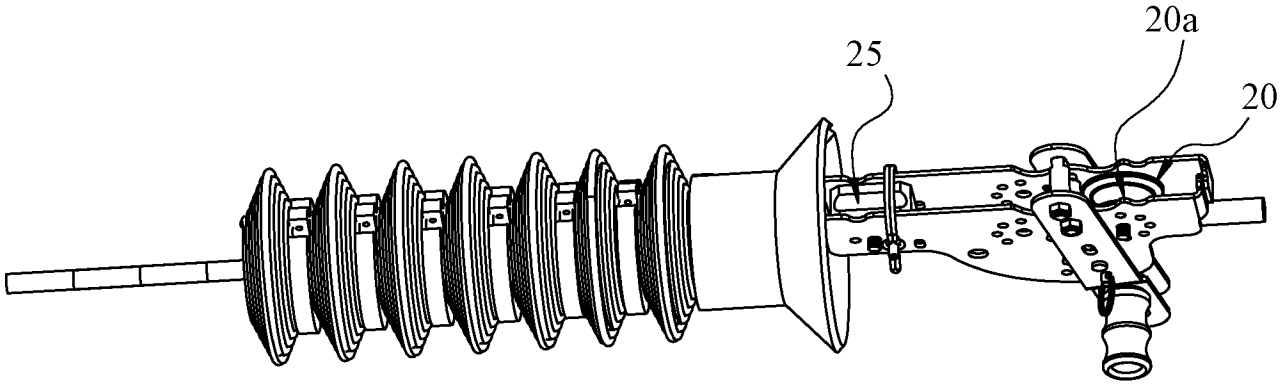
FIG. 49 is a top perspective view of a zipline trolley stopped by a compressed spring.

FIG. 49 is a top perspective view of the zipline trolley 10 stopped by the compressed spring 110*b*. The receiver 120 receives the zipline trolley 10, activating the brake pad 25, increasing the braking force. The wheel 20 and one direction internal sprag bearing 20*a* prevent the zipline trolley 10 from rolling backwards.

Figure 50:
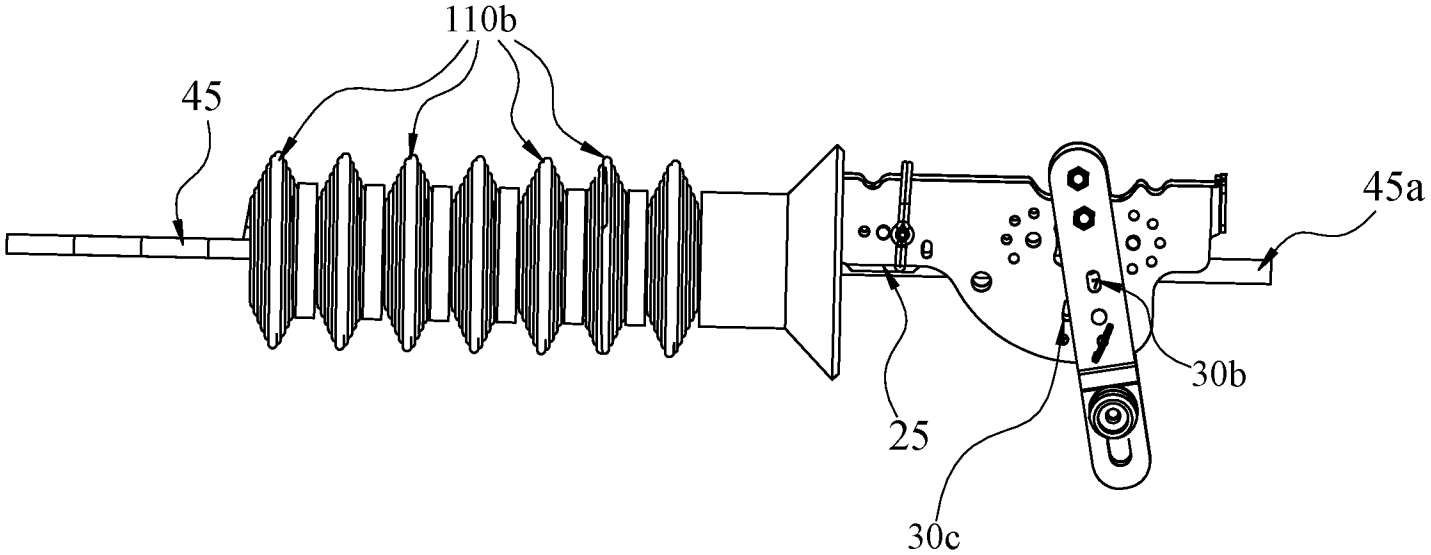
FIG. 50 is a side perspective view of a zipline trolley stopped by a compressed spring.

FIG. 50 is a side perspective view of the zipline trolley 10 stopped by the compressed spring 110*b*. The toothed slot 30*c* allows for three lever 35 placements. Numbering position seven 30*b* may allow minimum brake force position of the rider 5 suspended from the lever arm 35. Numbering position 30*b* is one of three toothed slots 30*c* providing differing amounts of brake force.

Figure 51:
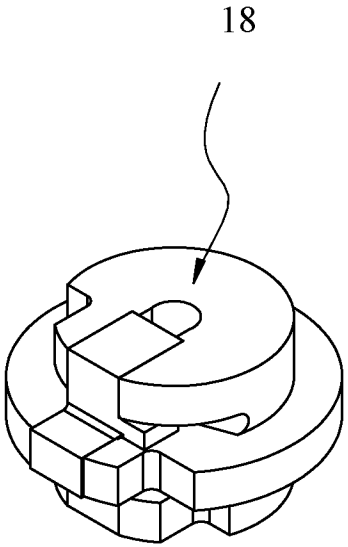
FIG. 51 is a perspective drawing illustrating one embodiment of a spring spacer.

FIG. 51 is a perspective drawing illustrating one embodiment of a spring spacer 18.

Figure 52:
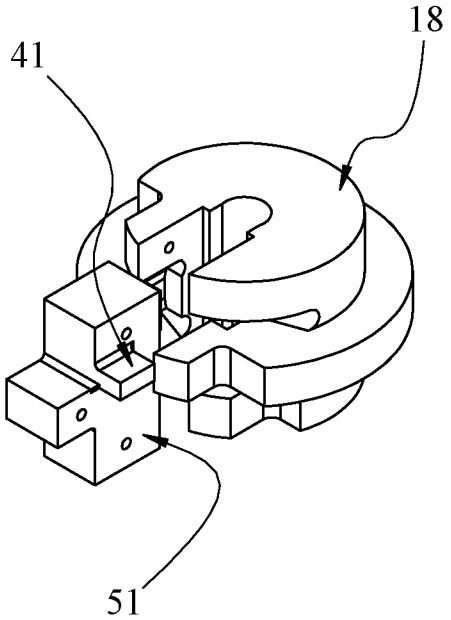
FIG. 52 is a perspective drawing illustrating one embodiment of a spring spacer.

FIG. 52 is a perspective drawing illustrating one embodiment of a spring spacer 18. An insert lock 51 is shown sliding out from the spring spacer 18. A protruding tabs 41 is shown.

Figure 53:
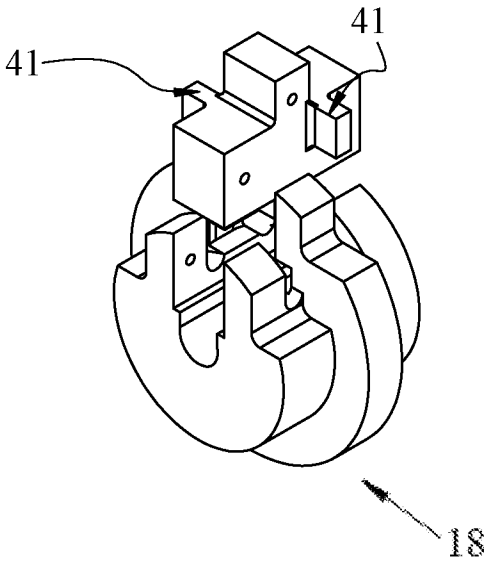
FIG. 53 is a perspective drawing illustrating one embodiment of a spring spacer.

FIG. 53 is a perspective drawing illustrating one embodiment of a spring spacer 18. An insert lock 51 is shown sliding out from the spring spacer 18. Protruding tabs 41 are shown.

Figure 54:
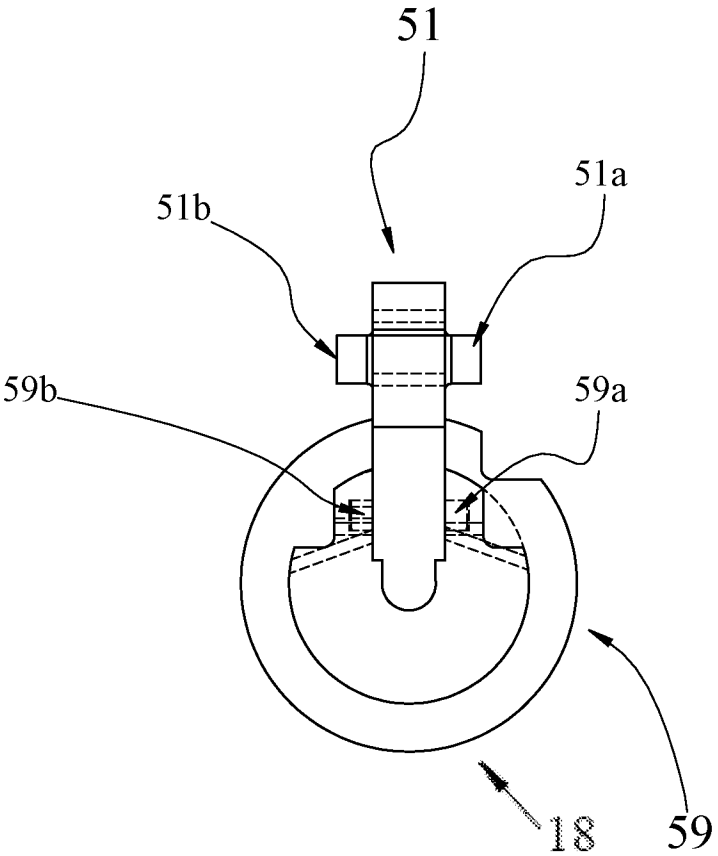
FIG. 54 is a side view drawing illustrating one embodiment of a spring spacer.

FIG. 54 is a side view drawing illustrating one embodiment of a spring spacer 18. Protruding tabs 41 are shown. Insert lock notches 59 are also shown. The insert lock notches 59 may lock the spring coil ends 16*a/b* and allow the spring 18 to compress against the spring spacer 18.

Figure 55:
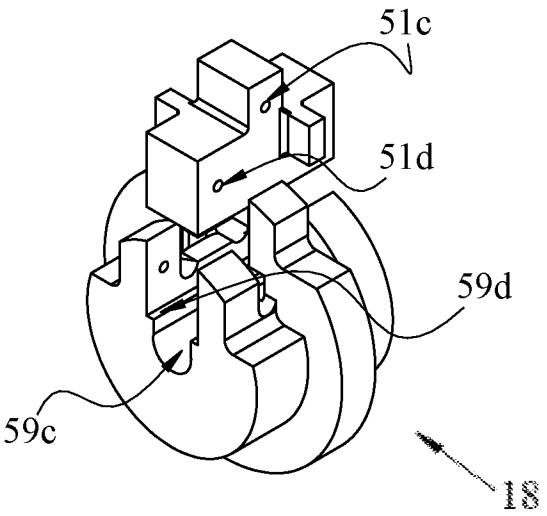
FIG. 55 is a perspective drawing illustrating one embodiment of a spring spacer.

FIG. 55 is a perspective drawing illustrating one embodiment of a spring spacer 18. An insert lock 51 is shown sliding out from the spring spacer 18. Insert lock holes 51*c/d* are shown. Insert lock notches 59*c/d* are also shown.

Figure 56:
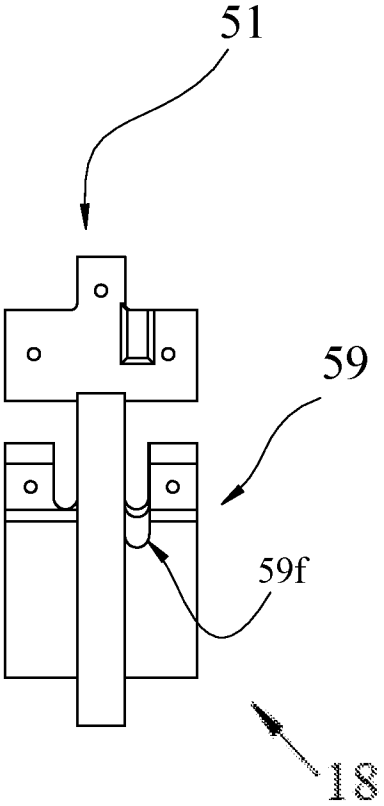
FIG. 56 is a side view drawing illustrating one embodiment of a spring spacer.

FIG. 56 is a side view drawing illustrating one embodiment of a spring spacer 18. The insert lock 51 and lock notches 59/59*f* are shown.

Figure 57:
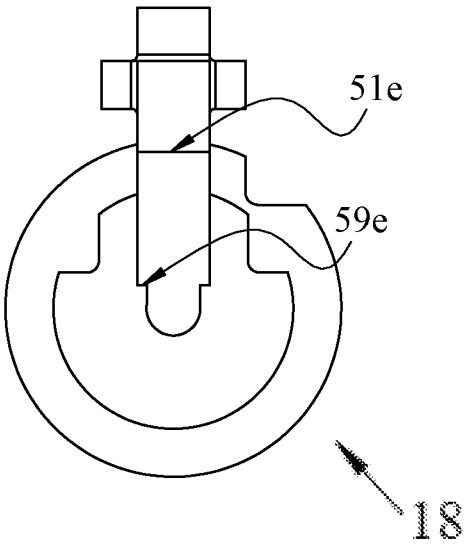
FIG. 57 is a side view drawing illustrating one embodiment of a spring spacer.

FIG. 57 is a side view drawing illustrating one embodiment of a spring spacer. The insert lock 51*e* and a lock notch 59*e* are shown.

Figure 58:
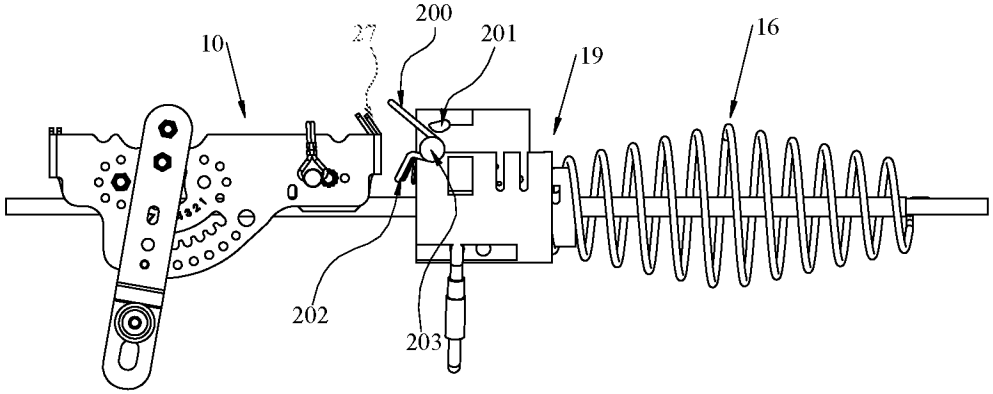
FIG. 58 is a side view drawing illustrating one embodiment of a zipline trolley.

FIG. 58 is a side view drawing illustrating one embodiment of a zipline trolley 10 with brake stop angled tab hitch 27 before contacting a modified bump receiver 19 with a compression spring 202 loaded or ready to receive catcher lever arm 200 an internal rotating shaft 203 a rotating cam 201 catcher and a barrel spring 16. The rotating cam 201 rotates to lock the receive catcher lever arm 200 down compressing the spring 202 once the trolley 10 has impacted the modified bump receiver 19 the rotating cam 201 rotates down holding 200 in place so the bottom tower staff member can real the trolley and rider in to the platform.

Figure 59:
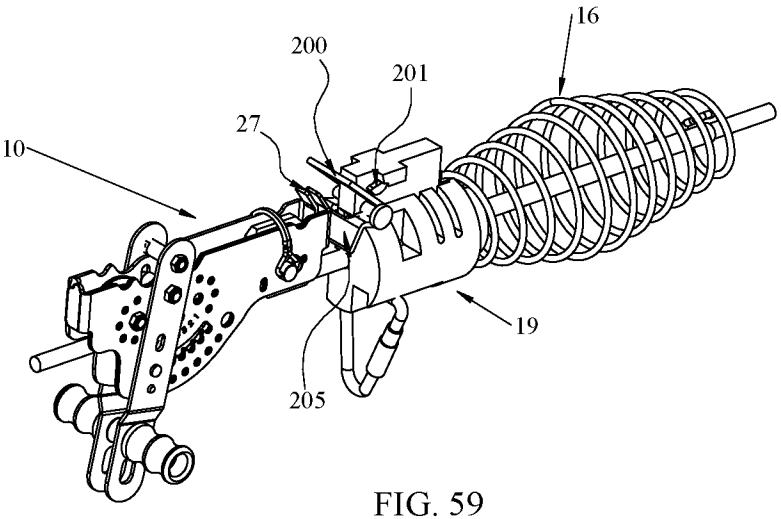
FIG. 59 is a perspective drawing illustrating one embodiment of a zipline trolley.

FIG. 59 is a perspective drawing illustrating one embodiment of a zipline trolley 10 with brake stop angled tab hitch 27 before contacting a bump receiver 19 with a compression spring loaded bump plate 205 and a rotating cam 201 a loaded or ready to receive the zipline trolley 10 and a barrel spring 16. The brake stop angled tab hitch 27 is received by the receive catcher 200 and locked in place by the receive catcher 200.

Figure 60:
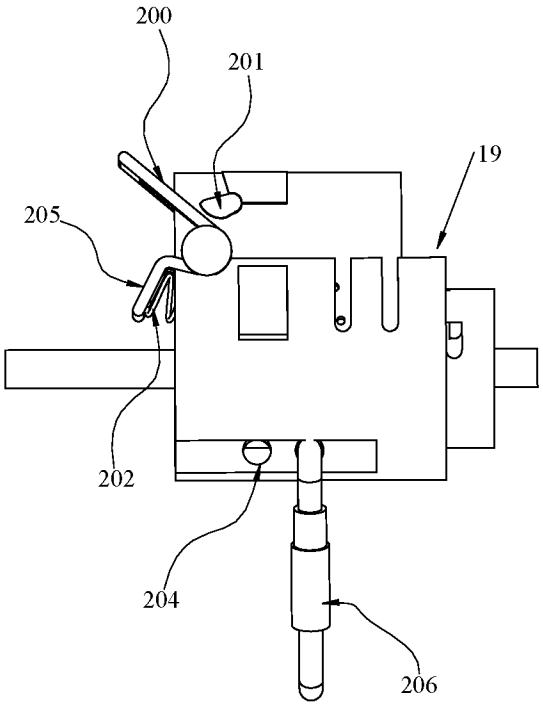
FIG. 60 is a side view drawing illustrating one embodiment of a bump receiver.

FIG. 60 is a side view drawing illustrating one embodiment of a bump receiver 19 with a loaded or ready to receive catcher 200, a compression spring 202 loaded or ready to receive catcher 200, a rotating cam 201, the bump plate 205, and a hole 204 for a carabiner 206.

Figure 61:
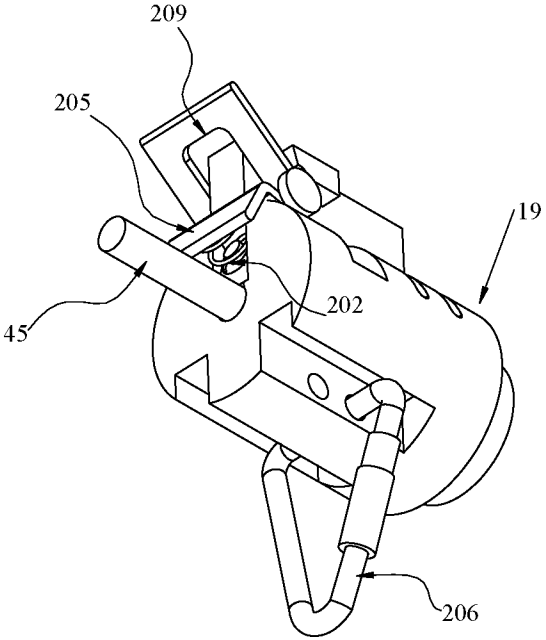
FIG. 61 is a perspective underside view drawing illustrating one embodiment of a bump receiver.

FIG. 61 is a perspective underside view drawing illustrating one embodiment of a bump receiver 19 with a spring loaded bump plate 205 for the receiver catcher 200 and the catcher hole 209 is ready to catch a zipline trolley 10 riding on the cable 45 and a carabiner 206.

Figure 62:
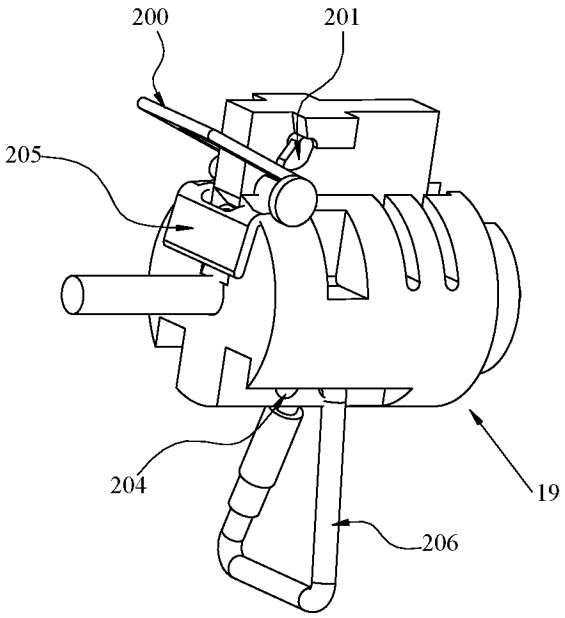
FIG. 62 is a perspective view drawing illustrating one embodiment of a bump receiver.

FIG. 62 is a perspective view drawing illustrating one embodiment of a bump receiver 19 with a compressed catcher 200, a locked cam 201 compressing the bump plate 205 compressed against bump receiver 19, and a hole 204 for a carabiner 206.

Figure 63:
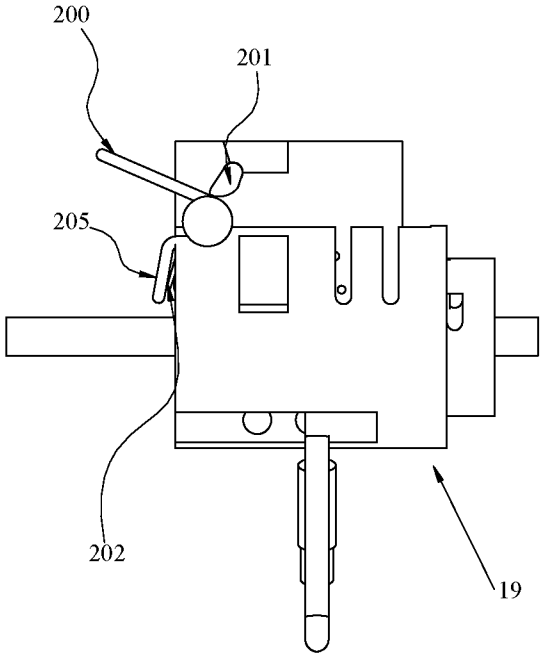
FIG. 63 is a side view drawing illustrating one embodiment of a bump receiver.

FIG. 63 is a side view drawing illustrating one embodiment of a bump receiver 19 compressing the compression spring 202. The bump plate 205 adjacent to the bump receiver 19 is locked in place by the cam lock 201 staying movement.

Figure 64:
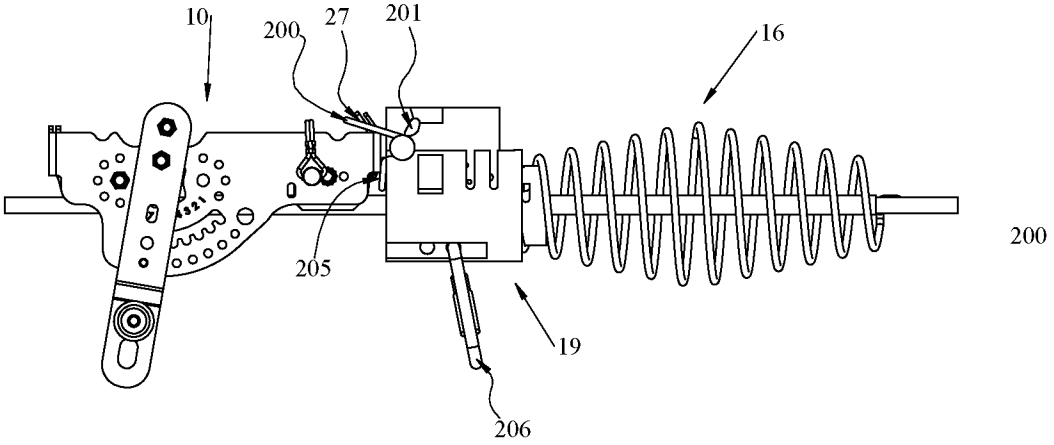
FIG. 64 is a side view drawing illustrating one embodiment is a zipline trolley.

FIG. 64 is a side view drawing illustrating one embodiment is a zipline trolley 10 mating with the bump receiver 19 with the receive catcher 200 connecting the zipline trolley 10 with the bump receiver 19 pressing the catcher face plate 205 so the zipline attendant can pull the zipline rider in with a rope connected to a carabiner 206 on the bottom of the bump receiver 19. The rotating cam 201 keeps the receive catcher 200 from springing back and mates the bump receiver 19 and the zipline trolley 10.

Figure 65:
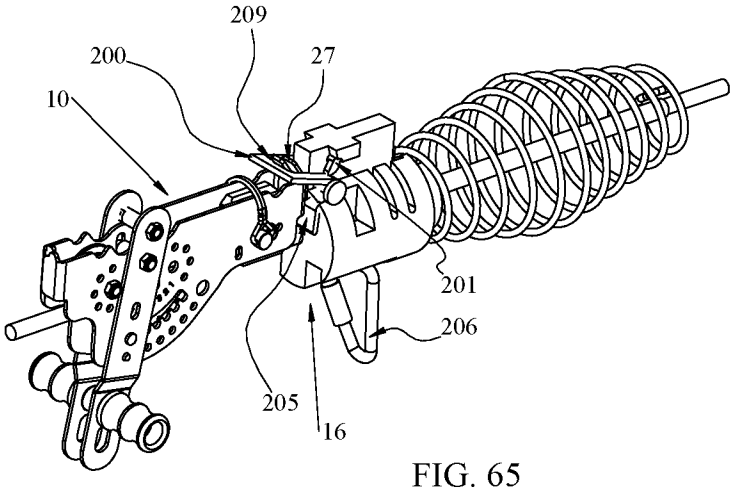

FIG. 65 is a perspective view drawing illustrating one embodiment is a zipline trolley 10 mating with the bump receiver 19 with the receive catcher 200 connecting the trolley's 10 brake stop angled tab hitch 27 nested in the catcher hole 209 with the catcher receiver 200 locking cam 201 as the stop pressed the catcher face plate 205 locking the brake stop angled tab hitch 27 so the zipline attendant can pull the zipline rider in with a rope connected to a carabiner 206 on the bottom of the bump receiver 19. The cam lock 201 keeps the catcher lever 200 from springing back so the trolley 10 and the bump receiver 19 can be towed to a platform.

Embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A zipline trolley comprising:

one wheel, wherein the wheel is disposed on a proximal end of a frame and comprises a groove that receives a cable at a lower portion of the wheel and a wheel bearing;

a brake disposed on a distal end of the frame and is connected to a given lever point and comprising a groove along a brake bottom that receives the cable;

the frame comprising an array of lever points disposed between the brake and the wheel;

a hanger connected to a given lever point and suspends a weight, wherein the weight applies a force about the wheel to the brake at a lever angle and a lever distance to control a rate of descent of the device along the cable, wherein the brake applies a first frictive force to the cable with a first force to surface area ratio in a direction of travel and a second frictive force opposite the direction of travel, and wherein the hanger is further connected to at least one sliding bar that slides within a slider groove and a brake force is applied by downward motion atop the cable by a weight of a suspended rider; and a lower slot configured to receive the cable and to allow the device to be removed from the cable when the hanger is removed from the given lever point.

2. The zipline trolley of claim 1, the zipline trolley further comprising a spring segment, the spring segment comprising:

two spring sub-segments each comprising a set of spring coils, each spring coil set comprising a large diameter end and a small diameter end, wherein each of the spring coils of the spring segment nests completely within a neighboring spring coil and a cable passes through the spring coils;

an end cap disposed on the large diameter end of the spring coils, the end cap comprising a hole that receives the cable; and a guide that connects the two sets of spring coils of the spring sub-segments at the small diameter ends, the guide guiding the cable through a center of the spring segment, wherein the guide and the end caps are configured to be in contact upon a full compression of the spring coil segment.

3. The zipline trolley of claim 2, wherein an insert lock seamlessly fills a spring spacer slot.

4. The zipline trolley of claim 2, wherein the insert lock is secured to the guide with lag screws.

5. The zipline trolley of claim 2, wherein an outer diameter of the spring coils are 5 inches plus or minus 0.5 inches.

6. The zipline trolley of claim 2, wherein the spring spacer is formed of Ultra High Molecular Weight Polyethylene.

7. The zipline trolley of claim 2, wherein the spring coils are 4-10 mm carbon or stainless spring steel and compress in the range of 40 to 100 lbs.

8. The zipline trolley of claim 2, the spring segment further comprising a spring termination hook that is rotated into a lock position in the guide.

9. The zipline trolley of claim 8, wherein the spring termination hook is locked into the guide and the insert secures the spring end in place.

10. The zipline trolley of claim 1, wherein the brake slides atop a zipline cable.

11. The zipline trolley of claim 1, the zipline trolley further comprising a lever and a safety lock pin, wherein the safety lock pin and a rider suspended carabiner is removed from the lever allowing the lever to be ratcheted up in a vertical motion.

12. The zipline trolley of claim 11, wherein the lever is rotated to another numbered position then slid downward to another numbered toothed position.

13. The zipline trolley of claim 11, wherein the lever is in a numbered position locked in place by the safety lock pin.

14. The zipline trolley of claim 11, wherein the safety lock pin is repositioned after brake rotation.

15. The zipline trolley of claim 4, wherein the safety lock pin is removed allowing a 90-270 degree the rotation worn brake to an unworn brake side.

16. The zipline trolley of claim 1, wherein the wheel descends atop a ⅜-¾ cable.

17. The zipline trolley of claim 1, wherein the zipline trolley brake groove worn by numerous cable descents through one brake side bolt circles holes.

18. The zipline trolley of claim 1, wherein the wheel comprises a parabolic groove.

* * * * *